US012320246B2

(12) United States Patent
Mammadov et al.

(10) Patent No.: US 12,320,246 B2
(45) Date of Patent: Jun. 3, 2025

(54) INTERNET OF THINGS IN MANAGED PRESSURE DRILLING OPERATIONS

(71) Applicant: Opla Energy Ltd., Calgary (CA)

(72) Inventors: Elvin Mammadov, Calgary (CA); Shawn Cody, Calgary (CA)

(73) Assignee: Opla Energy Ltd., Calgary (CA)

( * ) Notice: Subject to any disclaimer, the term of this patent is extended or adjusted under 35 U.S.C. 154(b) by 0 days.

(21) Appl. No.: 18/539,191

(22) Filed: Dec. 13, 2023

(65) Prior Publication Data

US 2024/0159139 A1 May 16, 2024

Related U.S. Application Data

(63) Continuation of application No. 18/110,360, filed on Feb. 15, 2023, now Pat. No. 11,885,213, which is a continuation of application No. PCT/CA2022/050500, filed on Apr. 1, 2022.

(60) Provisional application No. 63/169,684, filed on Apr. 1, 2021.

(51) Int. Cl.

| | |
|---|---|
| ***E21B 44/00*** | (2006.01) |
| ***E21B 21/08*** | (2006.01) |
| ***E21B 44/06*** | (2006.01) |

(52) U.S. Cl.

CPC ..... *E21B 44/06* (2013.01); *E21B 2200/22* (2020.05)

(58) Field of Classification Search

CPC ..... E21B 44/00; E21B 21/08

See application file for complete search history.

(56) References Cited

U.S. PATENT DOCUMENTS

| | | | | |
|---|---|---|---|---|
| 5,063,776 | A * | 11/1991 | Zanker | G01F 1/002 73/152.21 |
| 6,257,354 | B1 * | 7/2001 | Schrader | E21B 21/08 175/48 |
| 9,074,468 | B1 | 7/2015 | Selman et al. | |
| 10,294,742 | B2 | 5/2019 | Lovorn et al. | |
| 10,961,794 | B2 * | 3/2021 | Parthasarathy | E21B 21/08 |

(Continued)

FOREIGN PATENT DOCUMENTS

WO 2012027245 A1 3/2012

OTHER PUBLICATIONS

Written Opinion of the International Searching Authority dated Jun. 13, 2022 in corresponding International Application No. PCT/CA2022/050500 filed Apr. 1, 2022; total 7 pages.

(Continued)

*Primary Examiner* — Kipp C Wallace

(74) *Attorney, Agent, or Firm* — Snell & Wilmer L.L.P.

(57) ABSTRACT

A control system for a pressure management apparatus (PMA) of a drilling system has an onsite device in close proximity to and in communication with the PMA and an offsite device at a remote location. Both the onsite and offsite devices are connected to a network, such as the Internet, through which the devices can communicate with one another. The onsite device receives data in real-time from the PMA and the offsite device can access the data in real-time via the network. The offsite device can generate a command based on the data or user input at the offsite device and send the command to the onsite device to modify one or more settings of the PMA. A control panel is displayed on the user interface of the offsite device to allow an operator to remotely control the PMA.

15 Claims, 13 Drawing Sheets

(56) References Cited

U.S. PATENT DOCUMENTS

| | | | | |
|---|---|---|---|---|
| 2002/0112888 | A1 | 8/2002 | Leuchtenberg | |
| 2004/0149446 | A1* | 8/2004 | Appleford | E21B 33/0355 166/368 |
| 2005/0092523 | A1* | 5/2005 | McCaskill | E21B 21/08 175/218 |
| 2008/0308272 | A1 | 12/2008 | Thomeer et al. | |
| 2010/0147511 | A1* | 6/2010 | Ollre | E21B 43/385 166/250.01 |
| 2012/0165997 | A1 | 6/2012 | Lewis et al. | |
| 2013/0270006 | A1 | 10/2013 | Selman et al. | |
| 2014/0027129 | A1* | 1/2014 | Hannegan | E21B 33/085 166/387 |
| 2014/0326505 | A1* | 11/2014 | Davis | E21B 44/02 175/24 |
| 2015/0053483 | A1 | 2/2015 | Mebane, III | |
| 2016/0097270 | A1 | 4/2016 | Pobedinski et al. | |
| 2016/0138351 | A1* | 5/2016 | Dillard | E21B 33/128 175/25 |
| 2017/0101827 | A1 | 4/2017 | Orban | |
| 2018/0363444 | A1* | 12/2018 | Hornblower | E21B 45/00 |
| 2019/0203548 | A1* | 7/2019 | Parthasarathy | E21B 44/00 |
| 2019/0251460 | A1* | 8/2019 | Lam | G06N 7/01 |
| 2019/0368299 | A1 | 12/2019 | Jorud | |
| 2020/0190939 | A1* | 6/2020 | Gray | E21B 34/04 |
| 2021/0062635 | A1* | 3/2021 | Ameen | E21B 21/08 |
| 2022/0213781 | A1* | 7/2022 | Parthasarathy | F04D 15/0088 |

OTHER PUBLICATIONS

International Search Report dated Jun. 13, 2022 in corresponding International Application No. PCT/CA2022/050500 filed Apr. 1, 2022; total 5 pages.

International Preliminary Report on Patentability dated Oct. 3, 2023 in corresponding International Application No. PCT/CA2022/050500 filed Apr. 1, 2022; total 8 pages.

Non-Final Office Action dated May 8, 2023 in corresponding U.S. Appl. No. 18/110,360, filed Feb. 15, 2023; total 21 pages.

Notice of Allowance dated Sep. 26, 2023 in corresponding U.S. Appl. No. 18/110,360, filed Feb. 15, 2023; total 8 pages.

* cited by examiner

INTERNET OF THINGS IN MANAGED PRESSURE DRILLING OPERATIONS

CROSS-REFERENCE TO RELATED APPLICATIONS

This application is a continuation of U.S. application Ser. No. 18/110,360 filed Feb. 15, 2023, which is a continuation of International Patent Application No. PCT/CA2022/050500 filed Apr. 1, 2022, which claims the benefit of U.S. Provisional Application No. 63/169,684, filed Apr. 1, 2021, the content of which is hereby incorporated by reference in its entirety.

FIELD

The present disclosure relates generally to wellbore drilling operations and, more particularly, to systems and methods for Internet of Things (IoT) monitoring and control of managed pressure drilling operations and/or apparatus.

BACKGROUND

Managed pressure drilling (MPD) techniques are used to drill wellbores. In MPD drilling operations, a MPD system uses a closed and pressurizable mud-return system, a rotating control device (RCD), and a choke manifold to control the wellbore pressure during drilling. The various MPD techniques used in the industry allow operators to manage the wellbore pressure in a controlled fashion during drilling, especially in conditions where conventional drilling techniques cannot be applied (e.g. deep water drilling).

A function of MPD is to help control kicks or influxes of formation fluids entering the wellbore during drilling. This can be achieved using an automated choke response in a closed and pressurized circulating system made possible by the rotating control device. A control system controls the chokes with an automated response by monitoring flow in and out of the well via various sensors, and software algorithms in the control system seek to maintain a mass flow balance. If a deviation from mass balance is identified, the control system initiates an automated choke response that changes the annular pressure profile of the wellbore and thereby changes the equivalent mud weight of the wellbore. This automated capability of the control system allows the system to perform dynamic well control or constant bottom-hole pressure (CBHP) techniques.

In addition to kick detection and automated choke control, various other operations are necessary on the rig to drill the well effectively and efficiently. For example, the control system used for managed pressured drilling may require coordination or communication with sensors located on the rig to function optimally.

Conventionally, the control system for MPD operations is located on the rig and requires a human operator on site to monitor and operate the control system. Whether the rig is situated on land or water, any time an operator is on site there is risk to the operator's safety. For the control system to operate, large amounts of data are collected from the various sensors in the MPD system in real-time for the control system's analysis and use. While conventional MPD systems, one of which is described in U.S. Pat. No. 10,113,408, can send such sensor data offsite for storage and subsequent analysis, the ability to monitor and control the MPD system in real-time is limited to the onsite control system, which is operated by a human operator at the well site.

Accordingly, the present disclosure aims to provide systems and methods that allow MPD operations and/or apparatus to be, at least partially, monitored and controlled offsite, in near real-time from almost anywhere in the world, such that the need to have a human operator onsite is eliminated or at least reduced.

SUMMARY

According to a broad aspect of the present disclosure, there is provided control system for controlling a pressure management apparatus in a drilling system of drilling site, the pressure management apparatus comprising a controller and a plurality of components controllable by the controller, the control system comprising: a network accessible via the Internet; an onsite device in communication with the controller and connected to the network, the onsite device being configured to receive data from the controller, the onsite device being located at or near the drilling site; and an offsite device connected to the network and in communication with the onsite device via the network, the offsite device being configured to receive the data from the onsite device via the network in real-time and to receive user input, the offsite device being located in a remote location from the drilling site, wherein the offsite device is configured to generate a command based on the data or the user input and send the command to the onsite device; and wherein the onsite device is configured to receive the command and send the command to the controller to cause the controller to modify at least one setting of the plurality of components of the pressure management apparatus.

In some embodiments, the network is part of a virtual private cloud.

In some embodiments, the network comprises one or more data channels.

In some embodiments, the network comprises one or more of: a proxy service; a managed clustered streaming service; a drilling data consumer; a streaming service for clients; a managed non-relational big database service; a software security service; a CRUD service; and a user authentication proxy.

In some embodiments, the pressure management apparatus comprises one or more data collection devices operably coupled to the controller, and the controller is configured to receive the data from the one or more data collection devices.

In some embodiments, the drilling system comprises an electronic drilling recorder system and the onsite device is in communication with the electronic drilling recorder system.

In some embodiments, the plurality of components comprises a choke having a choke motor and a choke valve motor, and the controller is configured to drive the choke motor to cause the choke to be more open or closed, and to drive the choke valve motor to place the choke online or offline.

In some embodiments, the choke comprises a choke housing; a choke cartridge configured to be removably receivable in the choke housing; and a choke cartridge motor, and the controller is configured to drive the choke cartridge motor to cause the choke cartridge to move relative to the choke housing.

In some embodiments, the plurality of components comprises a choke gut line; a flowline valve configured to control fluid flow in the choke gut line; and a flowline valve motor operably coupled to the flowline valve, and the controller is configured to drive the flowline valve motor to cause the flowline valve to open or close.

In some embodiments, the plurality of components comprises a bearing assembly; a bowl for receiving the bearing assembly; and a latching motor operably coupled to the bearing assembly or the bowl, and the controller is configured to drive the latching motor to cause the bearing assembly to move relative to the bowl.

In some embodiments, the pressure management apparatus comprises an optical sensing device.

According to another broad aspect of the present disclosure, there is provided a method comprising: connecting, by an offsite device, to the Internet, the offsite device being located at a remote location from a drilling site of a wellbore; connecting, by the offsite device, to an onsite device in communication with a pressure management apparatus (PMA) in a drilling system at the drilling site via an Internet service, the onsite device being at or near the drilling site; receiving, by the onsite device, PMA data from a controller of the PMA in real-time; receiving, by the offsite device, the PMA data in real-time from the onsite device via the Internet; generating, by the offsite device, a command based, at least in part, on one or both of the PMA data and user input at the offsite device; sending, by the offsite device, the command to the onsite device; receiving, by the onsite device, the command; sending, by the onsite device, the command to the controller; receiving, by the controller, the command; and modifying, by the controller, a setting of the PMA based on the command.

In some embodiments, the method comprises receiving, by the onsite device, EDR data from a rig of the drilling system in real-time; and receiving, by the offsite device, the EDR data in real-time from the onsite device via the Internet.

In some embodiments, the command is generated based, at least in part, on the EDR data.

In some embodiments, modifying the setting of the PMA occurs before, during, or after one of: drilling of the wellbore, connection of a drill string at the drilling site, tripping out of the drill string from the wellbore, circulation of fluid in the wellbore, reaming of the wellbore, handling of a kick or a loss while drilling the wellbore, and an offline operation.

In some embodiments, the command is generated by the offsite device based, at least in part, on the PMA data and one or more pre-set rules.

In some embodiments, the one or more pre-set rules are generated by the offsite device, are generated by the onsite device, are set by a user, or a combination thereof.

In some embodiments, the command is generated based on the PMA data, and the method comprises: generating, by the onsite device, an alert based on the PMA data; prior to generating the command, receiving by the offsite device, the alert from the onsite device; and generating, by the offsite device, the command in response to the alert.

In some embodiments, the command is generated based on the user input, and the method comprises: generating, by the onsite device, an alert based on the PMA data; prior to generating the command, receiving by the offsite device, the alert from the onsite device; prompting, by the offsite device, a user of the offsite device for input based on the alert; and receiving, by the offsite device, the user input from the user in response to the prompting.

In some embodiments, the PMA data comprises one or more of: a flow rate; a pressure; a temperature; a choke position; a choke valve position; a choke cartridge position; a flowline valve position; a bearing assembly position; an image; and a video.

In some embodiments, the EDR data comprises an injection pressure.

In some embodiments, the method comprises displaying, by the offsite device, a control panel for presenting at least some of the PMA data in real-time and receiving the user input.

In some embodiments, the method comprises, after modifying the setting of the PMA, receiving, by the onsite device, a confirmation from the PMA; receiving, by the offsite device, the confirmation from the onsite device; and updating, by the offsite device, the control panel.

In some embodiments, the remote location is at a distance from a second drilling site of a second wellbore, and the method comprises: connecting, by the offsite device, to a second onsite device in communication with a second PMA in a second drilling system at the second drilling site via the Internet service, the second onsite device being at or near the second drilling site; receiving, by the second onsite device, second PMA data from a controller of the second PMA in real-time; receiving, by the offsite device, the second PMA data in real-time from the second onsite device via the Internet; generating, by the offsite device, a second command based, at least in part, on one or both of the second PMA data and a second user input at the offsite device; sending, by the offsite device, the second command to the second onsite device; receiving, by the second onsite device, the second command; sending, by the second onsite device, the second command to the controller of the second PMA; receiving, by the controller of the second PMA, the second command; and modifying, by the controller of the second PMA, a setting of the second PMA based on the second command.

According to another broad aspect of the present disclosure, there is provided a control system for a managed pressure drilling system having a drill string and a drill bit extended into a wellbore, an electric drilling recorder system, a mud pump, and a pressure management apparatus (PMA) in communication with an annulus defined between the drill string and the wellbore, the control system being in communication with the pressure management apparatus, the control system comprising: an onsite device in communication with a control unit of the pressure management apparatus and the electronic drilling recorder system to receive data in substantially real-time, the data being collected by a plurality of sensors of the pressure management apparatus and the electronic drilling recorder; and an offsite device comprising: a user interface having a display; a control panel accessible via the display; and one or more processors in communication with the onsite device via a communication network, the one or more processors having access to a first set of instructions that, when executed by at least one of the one or more processors, causes the offsite device to: generate, on the control panel, one or more of a hole depth indicator showing a depth of the wellbore; a bit depth indicator showing a depth of the drill bit; a block height indicator showing a remaining length to a subsequent drill string segment connection; a flow in indicator showing a pump rate of a drilling fluid entering the wellbore; a flow out indicator showing a flow rate of a drilling mud entering the pressure management apparatus: a mud weight in indicator showing a mud weight of the drilling fluid entering the wellbore; a mud weight out indicator showing a mud weight of the drilling mud exiting the wellbore; a surface backpressure indicator showing a surface backpressure; a target surface backpressure indicator showing a target surface backpressure; an intermediate casing point (ICP) pressure indicator showing an ICP pressure; and an ICP equivalent circulating density (ECD) indicator showing an ICP ECD, iteratively update the control panel to display the one or more of the hole depth indicator, the bit depth indicator, the block height indicator, the flow in indicator, the flow out indicator, the mud weight in indicator, the mud weight out indicator, the surface backpressure indicator, the ICP pressure indicator, and the ICP ECD indicator in substantially real-time; and control the pressure management apparatus, via the onsite device, based at least in part on information displayed on the control panel.

In some embodiments, the first set of instructions further causes the offsite device to: generate, on the control panel, one or more of: a bottomhole pressure indicator showing a bottomhole pressure; a bottomhole ECD indicator showing a bottomhole ECD; a surface backpressure limit indicator showing a surface backpressure limit; a surge pressure indictor showing a surge pressure, and a trip speed indicator showing a trip speed; and iteratively update the control panel to display the one or more of the bottomhole pressure indicator, the bottomhole ECD indicator, the surface backpressure limit indicator, the surge pressure indicator, and the trip speed indicator in substantially real-time.

In some embodiments, the pressure management apparatus has a first choke, wherein the first set of instructions further causes the offsite device to: generate, on the control panel: a first choke status indicator showing a status of the first choke, and a first choke position indicator showing an openness of the first choke; and iteratively update the control panel to display the first choke status indicator and the first choke position indicator in substantially real-time.

In some embodiments, the first set of instructions further causes the offsite device to: generate, on the control panel, a graphical representation displaying one or more of: the depth of the wellbore; the depth of the drill bit; the remaining length; the pump rate of the drilling fluid; the flow rate of the drilling mud; the mud weight of the drilling fluid, the mud weight of the drilling mud; the surface backpressure; the target surface backpressure; the ICP pressure; the ICP ECD; the bottomhole pressure; the bottomhole ECD; the surface backpressure limit, the surge pressure; the trip speed; the status of the first choke; and the openness of the first choke, for a range of block heights of the wellbore; and iteratively update the control panel to display the graphical representation in substantially real-time.

In some embodiments, the control panel is configured to allow a user to select the range of block heights.

In some embodiments, the pressure management apparatus has a second choke, wherein the first set of instructions further causes the offsite device to: generate, on the control panel, a second choke status indicator showing a status of the second choke; generate, on the control panel, a second choke position indicator showing an openness of the second choke, and iteratively update the control panel to display the second choke status indicator and the second choke position indicator in substantially real-time.

In some embodiments, the graphical representation displays the status of the second choke and the openness of the second choke.

In some embodiments, the first set of instructions further causes the offsite device to: generate, on the control panel, a formation integrity test (FIT)/maximum allowable casing pressure (MACP) section allowing the user to input one or more of: a depth value, a bottomhole ECD value, and a pressure gradient value; and control the pressure management apparatus based at least in part on the depth value, the bottomhole ECD value, or the pressure gradient value.

In some embodiments, the first set of instructions further causes the offsite device to update, upon user request, information in the FIT/MACP section in substantially real-time.

In some embodiments, the first set of instructions further causes the offsite device to: generate, on the control panel, a pressure control section allowing the user to: select a mode of pressure control for the managed pressure drilling system, select a depth level, and to input a pressure value or an ECD value, the pressure control section showing a corresponding depth value for the depth level and a pressure or ECD for the depth level, update, upon user request, information in the pressure control section in substantially real-time; and control the pressure management apparatus based at least in part on the pressure value or the ECD value.

In some embodiments, the first set of instructions further causes the offsite device to: generate, on the control panel, a choke control section displaying a first mode indicator showing whether the first choke is in an automatic mode or a manual mode, the first mode indicator being configured to allow the user to select between the automatic mode and the manual mode, wherein when the first mode indicator is in the automatic mode, the first choke is controlled by the onsite device based at least in part on the information displayed on the control panel; and when the first mode indicator is in the manual mode, the status and openness of the first choke are adjustable by the user via user input in the choke control section, update, upon user request, information in the choke control section in substantially real-time; and when the first mode indicator is in the manual mode, control the pressure management apparatus based at least in part on the user input in the choke control section.

In some embodiments, the first set of instructions further causes the offsite device to: generate, on the control panel, a choke operator safety settings section allowing the user to input one or more of: a safe surface backpressure high limit, an emergency choke openness for the first choke, and an emergency choke openness for the second choke: update, upon user request, information in the choke operator safety settings section in substantially real-time; and control the pressure management apparatus based at least in part on the safe surface backpressure high limit, the emergency choke openness for the first choke, and the emergency choke openness for the second choke.

In some embodiments, the onsite device comprises a user interface having a display; an onsite control panel accessible via the display of the onsite device; and one or more processors having access to a second set of instructions that, when executed by at least one of the one or more processors of the onsite device, causes the onsite device to: generate, on the onsite control panel, one or more of a gain/loss gauge; a surface backpressure gauge, an ICP pressure gauge; a standpipe pressure gauge; a bottomhole pressure gauge; an ICP ECD gauge; a bottomhole ECD gauge, an annular friction losses gauge; a custom depth ECD gauge; and a custom depth pressure gauge; and iteratively update the onsite control panel to display the one or more of the gain/loss gauge, the surface backpressure gauge, the ICP pressure gauge, the standpipe pressure gauge, the bottomhole pressure gauge, the ICP ECD gauge, and the bottomhole ECD gauge in substantially real-time.

In some embodiments, the gain/loss gauge is shown as a vertical bar graph display.

In some embodiments, at least one of the surface backpressure gauge, the ICP pressure gauge, the standpipe pressure gauge, the bottomhole pressure gauge, the ICP ECD gauge, and the bottomhole ECD gauge is shown as a dial indicator display.

In some embodiments, the first choke comprises a choke cartridge, and the second set of instructions further causes the onsite device to: generate, on the onsite control panel, a choke cartridge status indicator showing whether the choke cartridge is inserted or removed; and iteratively update the onsite control panel to display the choke cartridge status indicator in substantially real-time.

In some embodiments, the first choke cartridge indicator comprises interactive buttons to allow a position of the choke cartridge to be set the user, and the second set of instructions further causes the onsite device to control the pressure management apparatus based at least in part on the interactive buttons of the first choke cartridge indicator.

In some embodiments, the second set of instructions causes the onsite device to: generate, on the onsite control panel, a PMA status indicator showing whether fluid is flowing through one or both of the first and second chokes or bypassing both of the first and second chokes, the PMA status indicator comprising interactive buttons to allow the flowing and the bypassing to be set by the user; iteratively update the onsite control panel to display the PMA status indicator in substantially real-time; and control the pressure management apparatus based at least in part on the interactive buttons of the PMA status indicator.

In some embodiments, the second set of instructions further causes the onsite device to: generate, on the onsite control panel, an operation indicator showing a current operation of the managed pressure drilling system, the operation indicator comprising interactive buttons to allow the current operation to be set by the user; iteratively update the onsite control panel to display the operation indicator in substantially real-time; and control the pressure management apparatus based at least in part on the interactive buttons of the operation indicator.

In some embodiments, the pressure management apparatus comprises a pressure management device positioned at a wellhead of the wellbore.

In some embodiments, the pressure management apparatus comprises an integrated pressure management device positioned at a wellhead of the wellbore.

In another broad aspect of the present disclosure, there is provided a computer-implemented method of controlling a drilling operation of a managed pressure drilling system for a wellbore, the method comprising:

(a) receiving a data stream from a pressure management apparatus and an electric drilling recorder system, the data stream generated in real-time by a plurality of sensors of the pressure management apparatus and the electronic drilling recorder;

(b) processing the data stream to generate operational information of the managed pressure drilling system, the operational information comprising one or more of:
- a depth of the wellbore;
- a depth of a drill bit in the wellbore;
- a remaining length to a subsequent drill string segment connection,
- a pump rate of a drilling fluid entering the wellbore;
- a flow rate of a drilling mud entering the pressure management apparatus;
- a mud weight of the drilling fluid entering the wellbore;
- a mud weight of the drilling mud exiting the wellbore;
- a surface backpressure;
- an intermediate casing point (ICP) pressure;
- an ICP equivalent circulating density (ECD);
- a bottomhole pressure;
- a bottomhole ECD;
- surface backpressure limit;
- a surge pressure;
- a trip speed;
- a status of a first choke of the pressure management apparatus;
- a status of a second choke of the pressure management apparatus;
- an openness of the first choke; and
- an openness of the second choke, (c) providing a visual display of the operational information on an offsite device remote from the wellbore;

(d) repeating (a) to (c) over time, to update the visual display throughout the drilling operation; and (e) controlling the pressure management apparatus based on a command, the command being determined based at least in part on the visual display.

In some embodiments, the computer-implemented method comprises receiving a user input via the visual display, and the command is determined based at least in apart on the user input.

BRIEF DESCRIPTION OF THE DRAWINGS

Embodiments will now be described by way of example only, with reference to the accompanying simplified, diagrammatic, not-to-scale drawings. Any dimensions provided in the drawings are provided only for illustrative purposes, and do not limit the scope as defined by the claims. In the drawings:

FIGS. 1A to 1C may be collectively referred to herein as FIG. 1.

DETAILED DESCRIPTION OF THE EMBODIMENTS

All terms not defined herein will be understood to have their common art-recognized meanings. To the extent that the following description is of a specific embodiment or a particular use, it is intended to be illustrative only, and not limiting. The following description is intended to cover all alternatives, modifications and equivalents that are included in the scope, as defined in the appended claims.

According to embodiments herein, a control system allows the monitoring and control of MPD operations and/or apparatus to be performed remotely and in near real-time from an offsite location via the Internet.

Figure 1A:
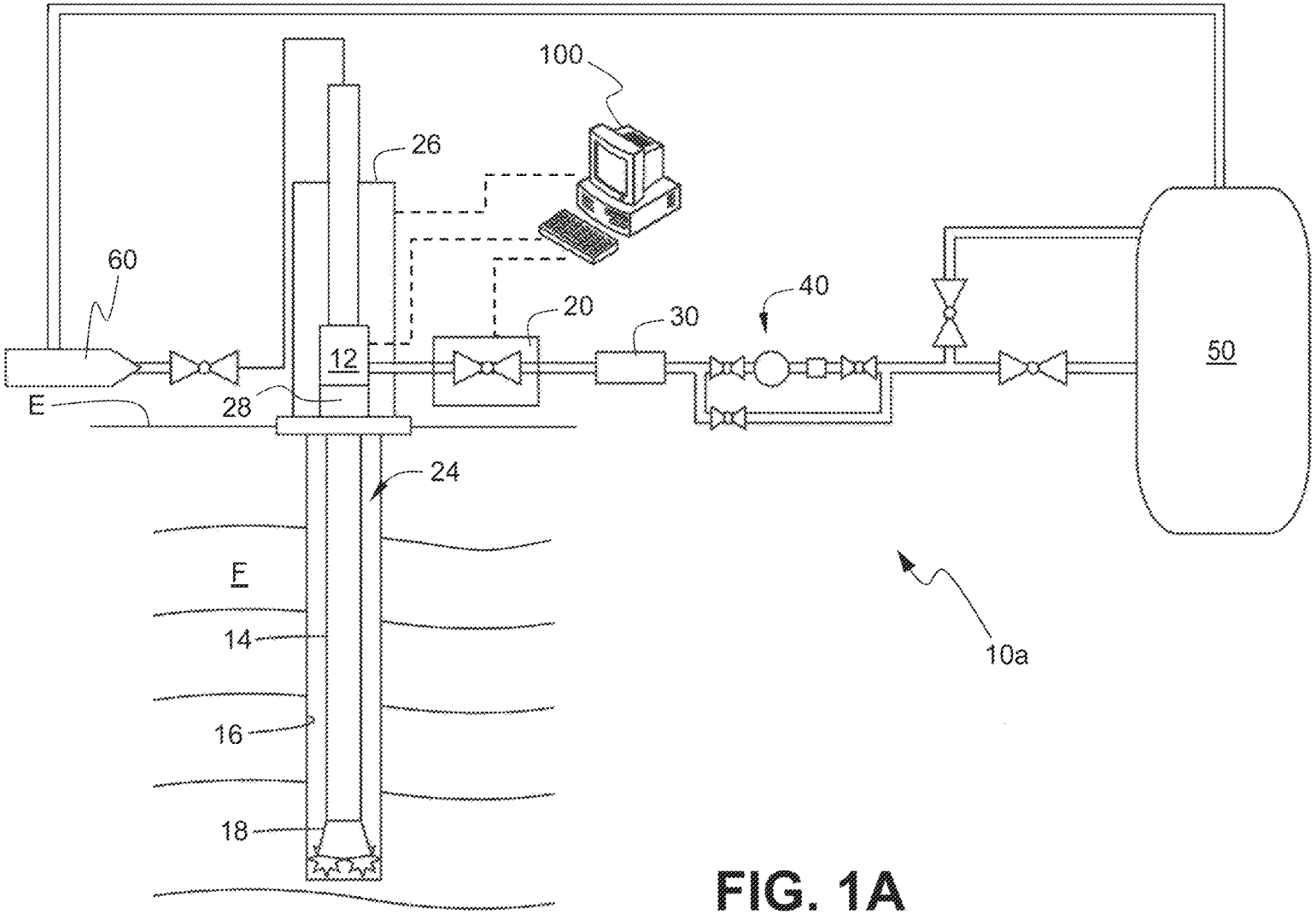
FIG. 1A is a schematic view of a managed pressure drilling system having a control system according to one embodiment of the present disclosure.

FIG. 1A illustrates an MPD system 10*a* for drilling a wellbore 16 through a formation F beneath the earth's surface E. The MPD system 10*a* comprises a rotating control device (RCD) 12 and a blowout preventor (BOP) stack 28, through which a drill string 14 sealingly extends. A portion of the drill string 14 extends downhole into the wellbore 16. The drill string 14 has a proximal end that is above surface E, above the RCD 12, and is coupled to a top drive (not shown) that is supported on a rig 26. The drill string 14 has a distal end that extends into the wellbore 16 and to which a drill bit 18 is affixed. A wellbore annulus 24 is defined between the outer surface of the drill string 14 and the inner surface of the wellbore 16. The system 10*a* also includes mud pumps 60, a standpipe (not shown), a mud tank (not shown), mud handling equipment 50, and various flow lines, as well as other conventional components such as a multiphase flowmeter 30 and a gas evaluation device 40.

The RCD 12 may be a conventional RCD comprising a bearing assembly (not shown) having a sealing element and a bowl (not shown) for receiving the bearing assembly. The drill string 14 is slidingly run through the sealing element of the bearing assembly. The sealing element seals around the outside diameter of the drill string 14, and rotates with the drill string 14 while the drill string 14 rotates relative to the bowl during drilling operations.

The MPD system 10*a* further comprises a choke manifold 20 that is positioned between and operably coupled to the RCD 12 and the mud handling equipment 50 via flow lines. The choke manifold 20 is downstream from the RCD 12 and is upstream from the mud handling equipment 50. The choke manifold 20 is in fluid communication with the annulus 24 via the RCD 12 and operates to manage the pressure inside the wellbore 16 during drilling. In some embodiments, the manifold 20 has one or more chokes (not shown), a mass flowmeter (not shown), one or more pressure sensors (not shown), a controller (not shown) for controlling the operation of the manifold 20, and a hydraulic power unit (not shown) and/or electric motor (not shown) to actuate the chokes. The mass flowmeter may be a Coriolis type of flowmeter.

The mud handling equipment 50 may include variety of apparatus, including for example shale shakers, mud tank, degasser, etc., and a skilled person in the art can appreciate that the specific apparatus to be used in equipment 50 may vary depending on drilling needs. The mud handling equipment is operably coupled to, and in fluid communication with, the mud pumps 60.

In operation, the MPD system 10*a* is used to control downhole pressure by manipulating surface applied pressure while the drill bit 18 extends the reach or penetration of the wellbore 16 into the formation F. To this end, the drill string 14 is rotated, and weight-on-bit is applied to the drill bit 18, thereby causing the drill bit 18 to rotate against the bottom of the wellbore 16. At the same time, the mud pumps 60 circulate drilling fluid to the drill bit 18, via the inner bore of the drill string 14. The drilling fluid is discharged from the drill bit 18 into the wellbore 16 to clear away drill cuttings from the drill bit 18. The drill cuttings are carried back to the surface E by the drilling fluid via the annulus 24. The drilling fluid and the drill cuttings, in combination, are also referred to herein as "drilling mud."

From the annulus 24, the drilling mud flows into the RCD 12 and the RCD sends the drilling mud to the choke manifold 20 while isolating the well 16 from atmospheric conditions. The RCD 12 may include any suitable pressure containment device that keeps the wellbore 16 in a closed-loop at all times while the wellbore is being drilled. The choke manifold 20 provides adjustable surface backpressure to the drilling mud to maintain a desired pressure profile within the wellbore 16. As the drilling mud flows through the choke manifold 20, the flowmeter of the choke manifold 20 measures return flow and density. The drilling mud exiting the choke manifold 20 flows to the mud handling equipment 50, whereby the drilling fluid is separated from the drilling mud. The separated drilling fluid is then recirculated by the mud pumps 60 to the drill bit 18, via the drill string 14.

Figure 1B:
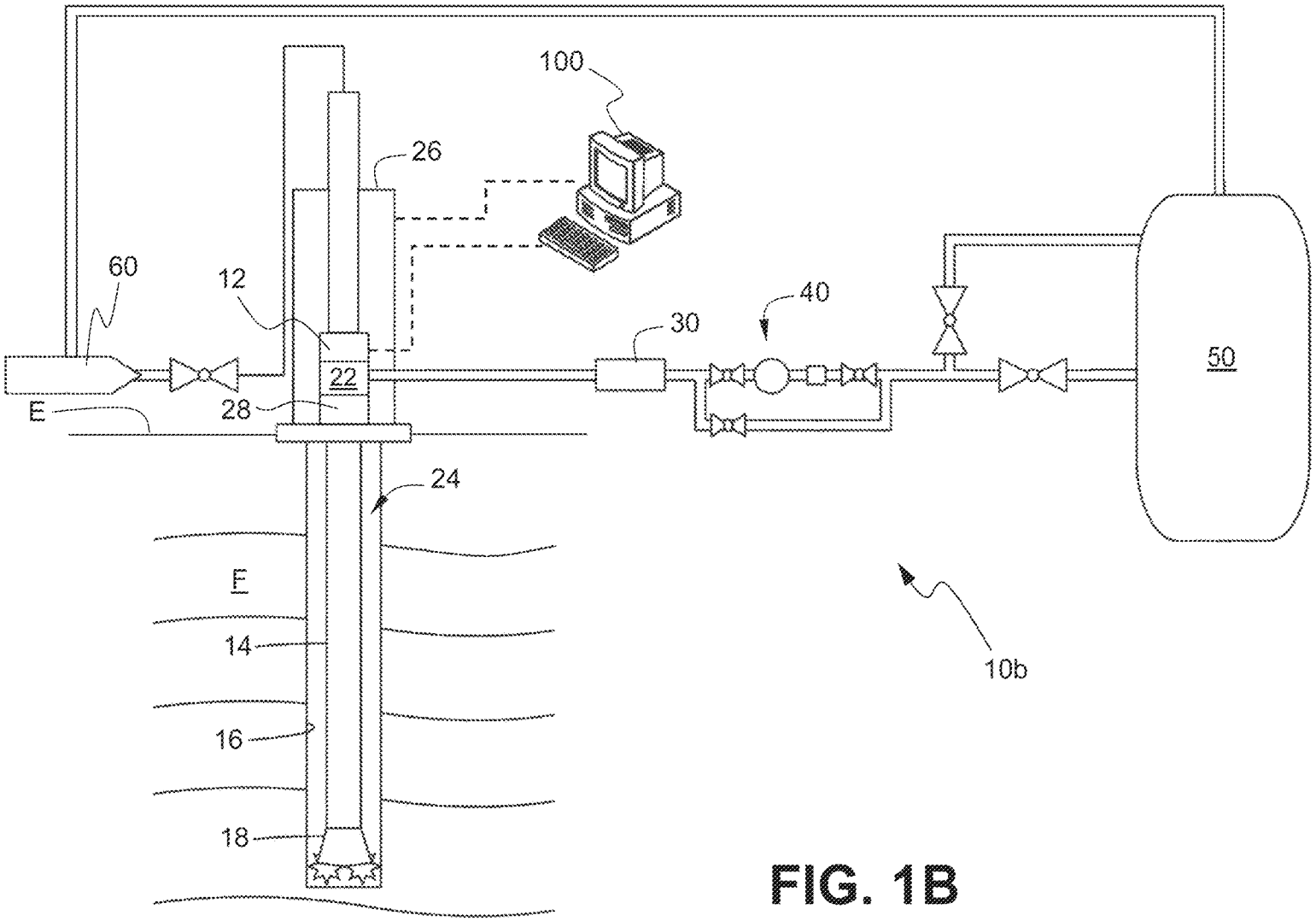
FIG. 1B is a schematic view of an alternative managed pressure drilling system having the control system according to another embodiment of the present disclosure.

FIG. 1B shows an alternative MPD system 10*b*. MPD system 10*b* has the same components as MPD system 10*a* (FIG. 1A) except system 10*b* comprises a pressure management device (PMD) 22 in place of the choke manifold 20. In the illustrated embodiment, the PMD 22 is positioned at the wellhead, attached to the RCD 12 on top of the BOP stack 28, and is configured to receive fluid from the wellbore annulus 24 via the BOP stack 28 and RCD 12. Like manifold 20, the PMD 22 operates to exert adjustable backpressure on the wellbore 16. In some embodiments, the PMD 22 comprises one or more chokes (not shown), a flowmeter (not shown), one or more pressure sensors (not shown), one or more position sensors (not shown), a controller (not shown) for controlling the operation of the PMD 22, and one or more hydraulic power units (not shown) and/or electric motors (not shown) for operating the PMD 22. An example of PMD 22 is disclosed by the Applicant in PCT Patent Application No. PCT/CA2021/050042, which is incorporated herein by reference in its entirety. Drilling mud exiting the wellbore annulus 24 flows into the PMD 22 via the BOP stack 28 and, from the PMD 22, the drilling mud is sent to the mud handling equipment 50 for processing and recirculation as described above.

Figure 1C:
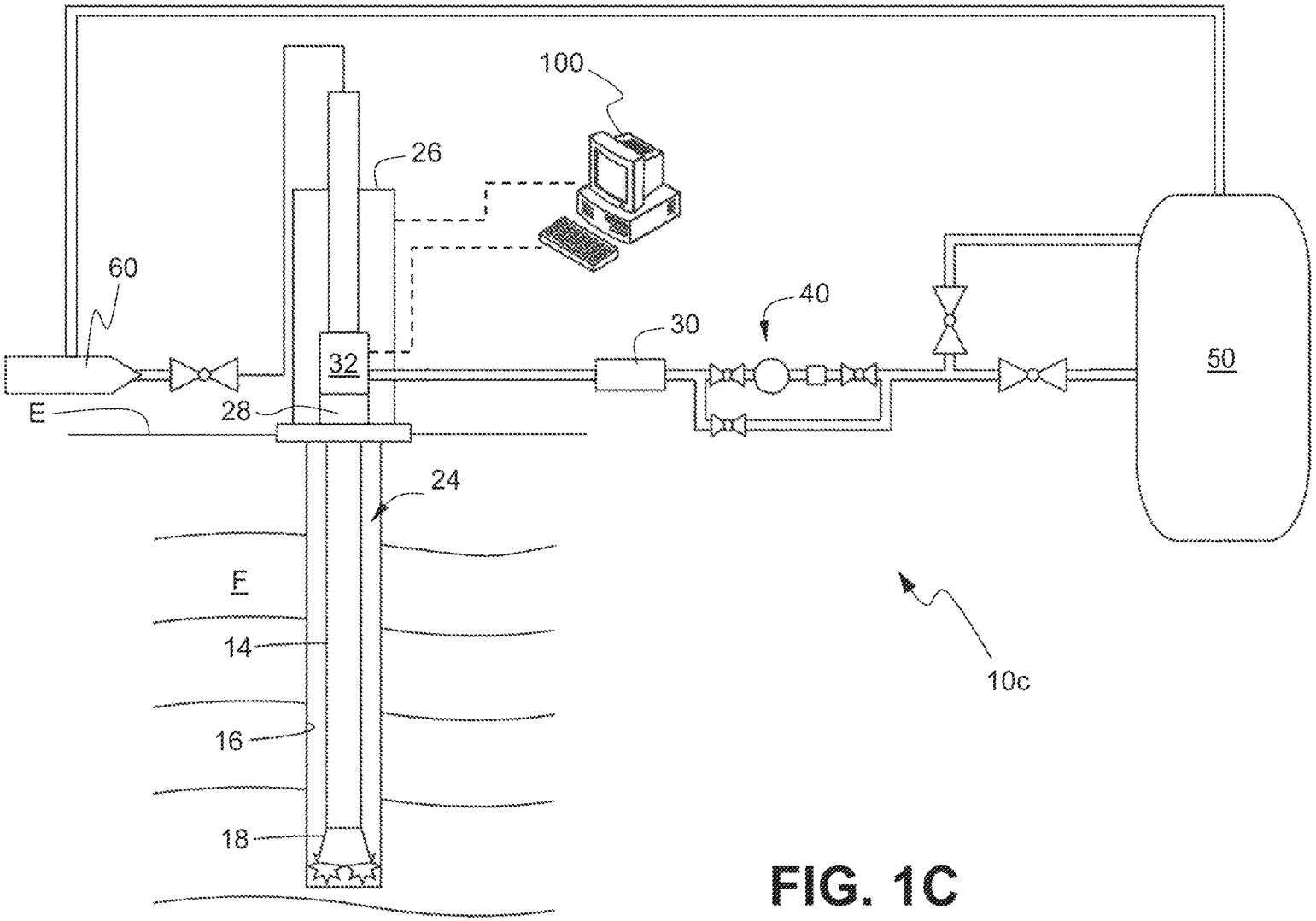
FIG. 1C is a schematic view of another managed pressure drilling system having the control system according to yet another embodiment of the present disclosure.

FIG. 1C shows another alternative MPD system 10*c*. MPD system 10*c* has the same components as MPD system 10*a* (FIG. 1A) except system 10*c* comprises an integrated pressure management device (IPMD) 32 in place of the RCD 12 and the choke manifold 20. In the illustrated embodiment, the IPMD 32 is connected to the BOP stack 28 at the wellhead and is configured to receive fluid from the wellbore annulus 24 via the BOP stack 28. The IPMD 32 is configured to perform the functions of both the RCD 12 and the choke manifold 20, i.e., applying backpressure on the wellbore 16 while sealing the wellbore 16 from the atmosphere. In some embodiments, the IPMD 32 comprises a bearing assembly (not shown), a bowl (not shown), one or more chokes (not shown), a flowmeter (not shown), one or more pressure sensors (not shown), one or more position sensors (not shown), a controller (not shown) for controlling the operation of the IPMD 32, and one or more hydraulic power units (not shown) and/or electric motors (not shown) for operating the IPMD 32. An example of IPMD 32 is also described in PCT Patent Application No. PCT/CA2021/050042. Drilling mud exiting the wellbore annulus 24 flows into the IPMD 32 via the BOP stack 28 and, from the IPMD 32, the drilling mud is sent to the mud handling equipment 50 for processing and recirculation as described above.

In the present disclosure, each of the combination of the RCD 12 and the choke manifold 20; the combination of the RCD 12 and PMD 22; and the IPMD 32 may be referred to as "pressure management apparatus" ("PMA").

With reference to FIG. 1, the MPD system 10*a*,10*b*,10*c* has a control system 100 configured to monitor and control the operational parameters of the system 10*a*,10*b*,10*c*, or at least the PMA of the system 10*a*,10*b*,10*c*. In some embodiments, the control system 100 is communicatively coupled to the MPD system 10*a*,10*b*,10*c* and has processing capabilities to monitor and control the system 10*a*,10*b*,10*c*.

Figure 2:
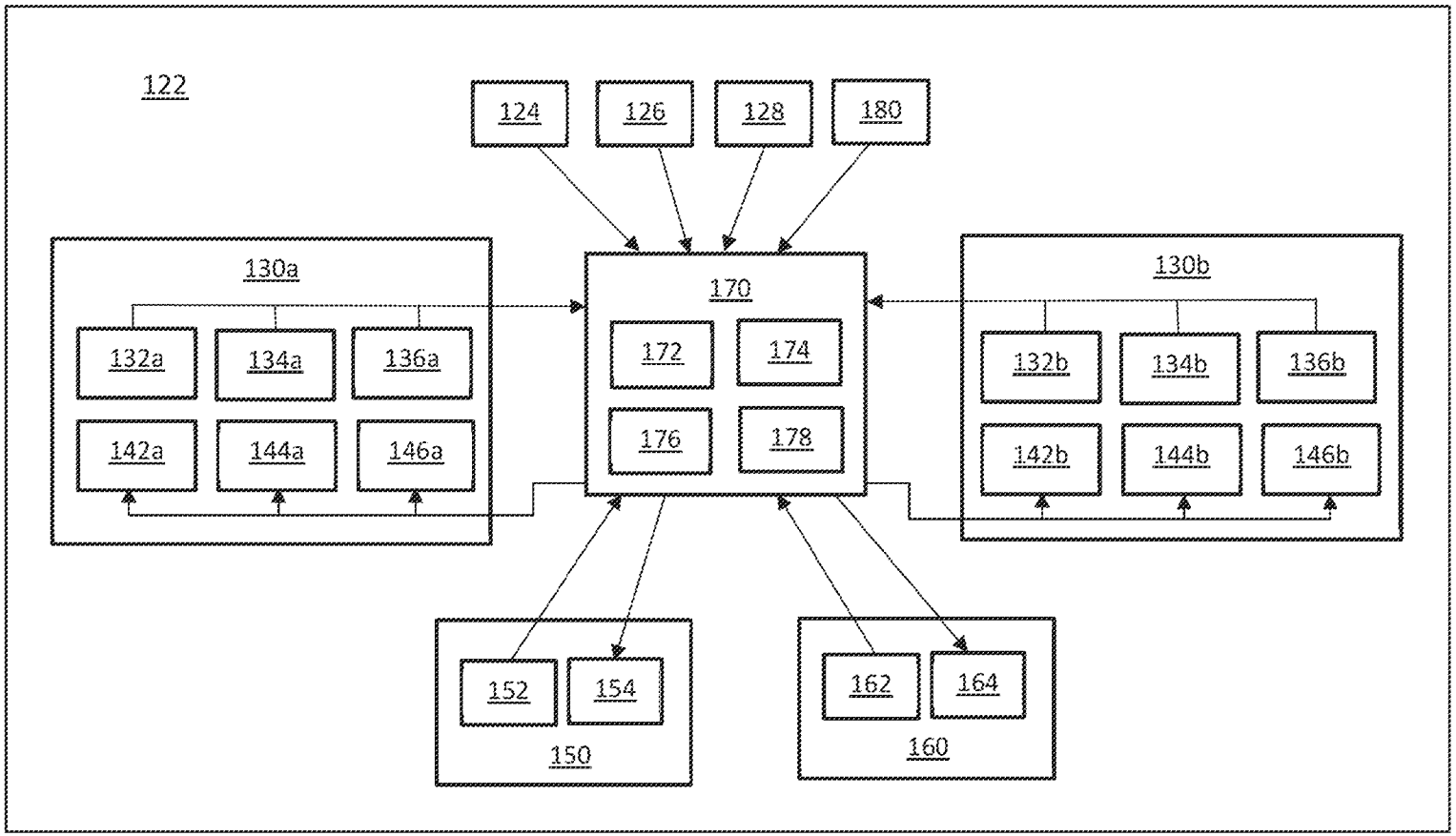
FIG. 2 is a schematic view of a pressure management apparatus of a managed pressure drilling system, according to one embodiment of the present disclosure.

FIG. 2 shows the sample components of the PMA 122. In some embodiments, the PMA 122 has a control unit 170. In some embodiments, the control unit 170 comprises a controller 172, a communication module 174, a motor drive module 176, and a radio remote control module 178. In some embodiments, the controller 172 may include a processor or other control circuitry configured to execute instructions of a program that controls operation of the PMA 122. The controller 172 may be a programmable logic controller (PLC) or any suitable controller known to those skilled in the art. In some embodiments, the controller 172 is configured to receive input from sensors and/or other components in the PMA 122 and control operations of one or more components of the PMA 122. In some embodiments, the controller 172 may use the communications format of WITS (Wellsite Information Transfer Specification) for a variety of data monitored and collected at the drilling site. In some embodiments, the controller 172 is configured to control the operation of one or more of the communication module 174, motor drive module 176, and radio remote control module 178. In some embodiments, the controller 172 is configured to execute commands that it receives from another device and/or commands that are based on pre-written code within the controller 172 to control the various below-described components of the PMA 122.

The communication module 174 is a communication device configured to exchange communications with another device via a wired or wireless connection. For example, the communication module 174 may be a wireless communication device configured to exchange communications over a wireless network. In some embodiments, the wireless communication device may include one or more of a GSM module, a radio modem, cellular transmission module, or any type of module configured to exchange communications in one of the following formats: GSM or GPRS, CDMA, EDGE or EGPRS, EV-DO or EVDO, UMTS, or IP. In another example, the communication module 174 may be a wired communication device configured to exchange communications using a wired connection. In some embodiments, the communication module 174 may be a modem, a network interface card, or another type of network interface device. In some embodiments, the communication module 174 may be an Ethernet network card configured to enable the control unit 170 to communicate over a local area network and/or the Internet.

The motor drive module 176 is configured to communicate with the controller 172 and receive commands from the controller 172. The motor drive module 176 is operably coupled to and in communication with one or more motors in the PMA 122 and, based on the commands received from the controller 172, the motor drive module 176 operates to drive the one or more motors.

The radio remote control module 178 is configured to communicate with the controller 172 and receive commands from the controller 172. In some embodiments, the radio remote control module 178 receives commands from the controller 172 via radio signals. The radio remote control module 178 is configured to wirelessly communicate with one or more mechanical devices (not shown), such as a joystick coupled to an actuator, for moving a part of the PMA 122 relative to another part of the PMA. For example, an actuator may be used to move the bearing assembly relative to the bowl of the PMA 122 and the movement of the actuator is controlled by a joystick, which may be manually operated by the operator or remotely operated by the radio remote control module 178 via radio signals. Based on commands from the controller 172, the radio remote control module 178 can actuate the joystick to move the bearing assembly relative to the bowl.

In some embodiments, the PMA 122 has a plurality of data collection devices, which may include one or more of: a pressure sensor, a temperature sensor, a position sensor, a flowmeter etc. In some embodiments, the PMA 122 comprises a pressure sensor 124, a temperature sensor 126, and a flowmeter 128, which may be located at or near an inlet (not shown) of the PMA 122 for measuring the pressure, temperature, flow rate of the fluid entering the PMA 122. The pressure sensor 124, the temperature sensor 126, and the flowmeter 128 may be in communication with the control unit 170 by wired (e.g., Ethernet, USB, etc.) or wireless (e.g., Wi-Fi, Bluetooth®, etc.) connection and may be configured to transmit data to the control unit 170.

In some embodiments, the PMA 122 has one or more chokes 130*a*,130*b*. Each choke 130*a*,130*b* may have a respective choke position sensor 132*a*,132*b* for determining the position of the choke trim relative to the choke orifice of the choke. The closer the choke trim is to the choke orifice, the more "closed" the choke is. A choke is fully closed if substantially no fluid can flow therethrough. Likewise, the farther away the choke trim is from the choke orifice, the more "open" the choke is. In some embodiments, the openness of a choke may be indicated by a percentage value, with 100% being fully open and 0% being fully closed. In the illustrated embodiment, each choke 130*a*,130*b* of the PMA 122 has a respective choke motor 142*a*,142*b* for driving an actuator (not shown) of the choke to change the position of the choke trim relative to the choke orifice of the choke, to make the choke more open or more closed.

In some embodiments, a respective choke valve position sensor 134*a*,134*b* is associated with each choke 130*a*,130*b* for determining whether the choke is "online" or "offline". A choke is online if it is in fluid communication with the wellbore annulus 24. A choke is offline if it is not in fluid communication with the wellbore annulus 24. Each choke 130*a*,130*b* may comprise a respective choke valve motor 144*a*,144*b* for driving an actuator (not shown) to render the choke online or on offline.

In some embodiments, one or more of the chokes 130*a*, 130*b* may be a cartridge-style type of choke, as described in PCT Patent Application No. PCT/CA2021/050042, wherein the choke comprises a choke housing and a choke cartridge removably received in the choke housing. In these embodiments, the choke 130*a*,130*b* may have a respective choke cartridge position sensor 136*a*,136*b* for determining the position of the choke cartridge relative to the choke housing, i.e., whether the choke cartridge is fully installed in the choke housing. When the choke cartridge is fully installed in the choke housing, the choke cartridge may be referred to as "inserted". When the choke cartridge is removed from the choke housing, the choke cartridge may be referred to as "removed". Where the choke 130*a*,130*b* is a cartridge-style type of choke, the choke may comprise choke cartridge motor 146*a*,146*b* for driving an actuator (not shown) to move the choke cartridge relative to the choke housing.

The choke position sensors 132*a*,132*b*, the choke valve position sensors 134*a*,134*b*, and the choke cartridge position sensors 136*a*,136*b* may be in communication with the control unit 170 by wired or wireless connection and are configured to transmit data to the control unit 170. The choke motor 142*a*,142*b*, the choke valve motor 144*a*,144*b*, and the choke cartridge motor 146*a*,146*b* may be in communication with the control unit 170 by wired or wireless connection and are configured to be driven by the motor drive module 176.

The PMA 122 may have a flowline valve 150 that controls fluid flow in a choke gut line (not shown) of the PMA 122. In some embodiments, if the choke gut line is open, fluid entering the PMA 122 flows through the choke gut line while bypassing the chokes 130*a*,130*b* and exits the PMA 122. If the choke gut line is closed, fluid entering the PMA 122 flows through one or more of the chokes 130*a*,130*b* and then exits the PMA 122. In some embodiments, the PMA 122 has a flowline valve position sensor 152 for determining whether the choke gut line is open or closed. The flowline valve position sensor 152 may be in communication with the control unit 170 by wired or wireless connection and is configured to transmit data to the control unit 170. In some embodiments, the PMA 122 has a flowline valve motor 154 for driving an actuator (not shown) to change the position of the flowline valve 150 for opening and closing the choke gut line. The flowline valve motor 154 may be is in communication with the control unit 170 by wired or wireless connection and is configured to be driven by the motor drive module 176.

In some embodiments, the PMA 122 comprises an RCD module 160 having a bearing assembly (not shown) and a bowl (not shown) for receiving the bearing assembly. In some embodiments, the RCD module 160 comprises at least one position sensor 162 for determining the position of the bearing assembly relative to the bowl, i.e., whether the bearing assembly is attached to the bowl. The position sensor 162 may in communication with the control unit 170 by wired or wireless connection and may be configured to transmit data to the control unit 170. In some embodiments, the RCD module 160 has a latching motor 164 for driving an actuator (not shown) to move the bearing assembly relative to the bowl, for the purposes of securing the bearing assembly to the bowl and releasing the bearing assembly from the bowl. The latching motor 164 may be in communication with the control unit 170 by wired or wireless connection and may be configured to be driven by the motor drive module 176. In some embodiments, the bearing assembly may be rotationally secured to the bowl, as described by the Applicant in U.S. Provisional Patent Application No. 63/115,720, which is incorporated herein by reference in its entirety.

In some embodiments, the PMA 122 comprises a digital camera 180 or other type of optical sensing device for capturing image and/or video of the PMA 122. In some embodiments, the camera 180 is used for capturing image and/or video of the RCD module 160, to help determine the position of the bearing assembly relative to the bowl. The camera 180 may be in communication with the control unit 170 by wired or wireless connection and may be configured to transmit data to the control unit 170. In some embodiments, the bearing assembly and/or the bowl may have visual indicators on the outer surface that can be easily captured by the camera 180 for facilitating the determination of the relative positions of the bearing assembly and the bowl.

It can be appreciated that other embodiments of the PMA 122 may comprise only some of the above-mentioned components. In alternative embodiments, instead of motors, the PMA may comprise other drive mechanisms, such as hydraulic power units, pneumatic power units, etc., for actuating one or more actuators (not shown) in the PMA. Each of above-mentioned sensors, flowmeter 128, and camera 180 of the PMA may continuously transmit data to the control unit 170, periodically transmit data to the control unit 170, or transmit data to the control unit 170 in response to a change in previously collected data.

Figure 3A:
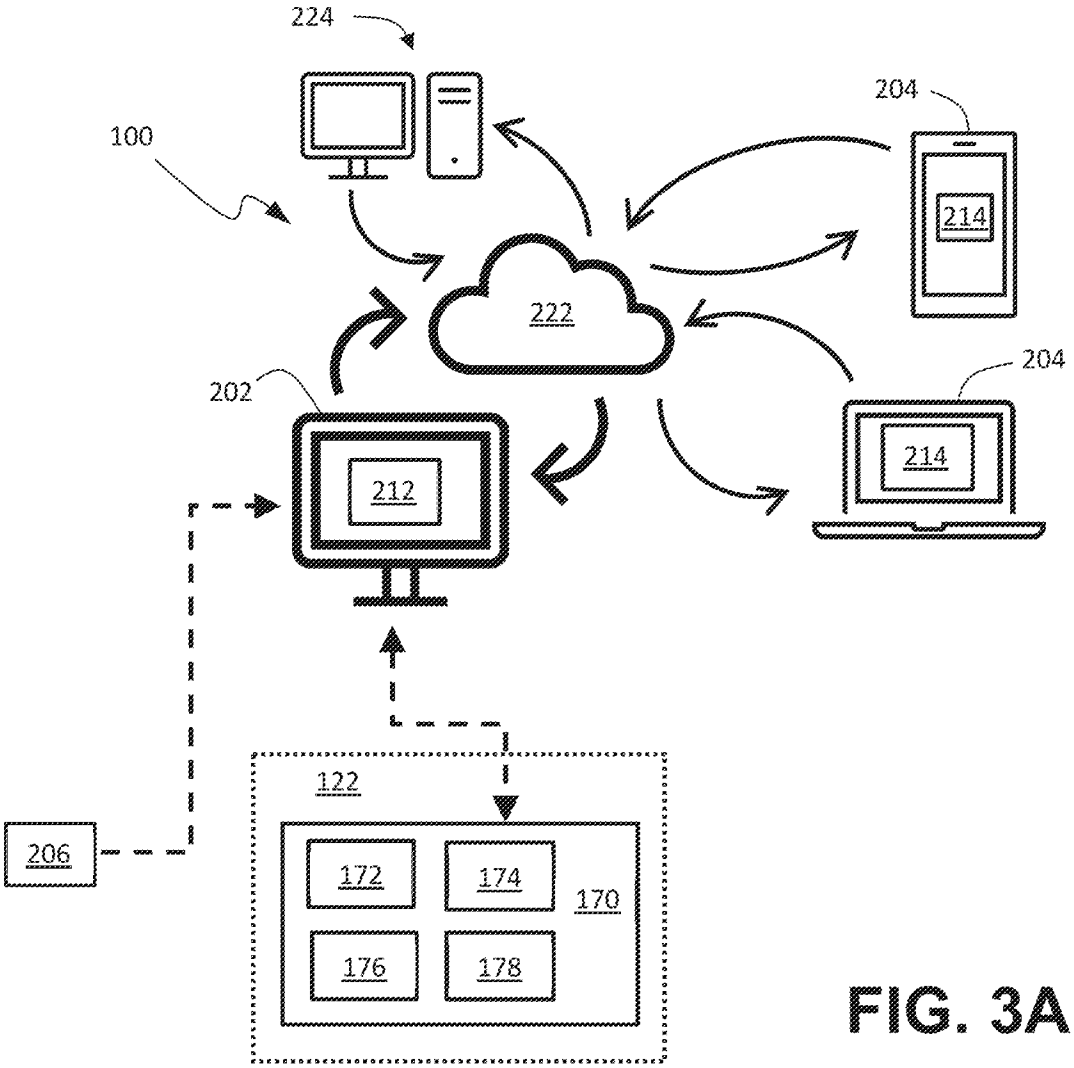
FIG. 3A is a schematic view of the control system, shown with its environment, according to one embodiment of the present disclosure.

FIG. 3A shows a sample configuration of the control system 100 in its environment. In the illustrated embodiment, the control system 100 is configured to allow an operator (also referred to as "user") to monitor and control the PMA 122 of a drilling system (e.g., MPD system 10*a*,10*b*,10*c* of FIG. 1) from an onsite location and an offsite location. While the control system 100 is described herein in relation to the monitoring and control of a PMA, it can be appreciated that the control system 100 may be configured to monitor and control other or additional components of the drilling system.

The system 100 comprises at least onsite communication device 202 and at least one offsite communication device 204, both connected to and in communication with an interactive communication network 222. Also connected to network 222 are one or more server computers 224, which store information and make the information available to the onsite and offsite devices 202,204. The network 222 allows communication between and among the onsite device 202, the offsite device 204, and the servers 224. The network 222 may be a collection of interconnected public and/or private networks that are linked together by a set of standard protocols to form a distributed network. While network 222 is intended to refer to what is now commonly referred to as the Internet, it is also intended to encompass variations which may be made in the future, including changes and additions to existing standard protocols. It may also include various networks used to connect mobile and wireless devices, such as cellular networks. When servers 224 are physically remote from users of the onsite and offsite devices 202,204, but are accessible to those users via network 222, the servers 224 are sometimes referred to herein as being "in the cloud." In some embodiments, the network 222 and servers 224 are part of a virtual private cloud (VPC). Servers 224 may use a variety of operating systems and software optimized for distribution of content via networks. The network 222 may include one or more networks that have wireless data channels. In some embodiments, the network 222 is configured to host data streaming platforms, such as for example Apache Kafka®, and/or database management services, such as for example Apache Cassandra®, to support the operation of system 100.

The onsite device 202 and offsite devices 204 may connect to the network 222 via a broadband connection such as a digital subscriber line (DSL), cellular radio, or other form of broadband connection to the Internet. In some embodiment, the onsite device 202 and/or the offsite devices 204 can access the network 222 via an Internet service, such as a web browser or an application on the device, which establishes a communication link with the network 222. The offsite device 204 may receive data from the onsite device 202 via network 222 or the servers 224 may relay data received from the onsite device 202 to the offsite device 204 through the network 222. In some embodiments, the servers 224 may facilitate communication between the onsite device 202 and the offsite device 204.

The onsite communication device 202 is located at the drilling site, in close physical proximity to the control unit 170 of the PMA 122. The onsite device 202 may comprise one or more processors and may be equipped with communications hardware such as modem or a network interface card. The one or more processors may be, for example, general-purpose processors, multi-chip processors, embedded processors, etc. In some embodiments, the onsite device 202 has a user interface and hosts one or more software programs and/or applications. The user interface may comprise one or more of: a keyboard, a mouse, a touch pad, a display, a touch screen, audio speakers, and a printer. In some embodiments, the onsite device 202 can receive user input via the user interface. The onsite device 202 may comprise a storage medium, which may include one or more of: random access memory (RAM), electronically erasable programmable read only memory (EEPROM), read only memory (ROM), hard disk, floppy disk, CD-ROM, optical memory, or other mechanisms for storing data.

The onsite device 202 may be operably coupled to and in communication with the control unit 170 of the PMA 122. The onsite device 202 may be wiredly (e.g., Ethernet) or wirelessly connected to the control unit 170 in, for example, a local communication network (e.g., local area network (LAN)) at the drilling site. In some embodiments, the onsite device 202 may also be in communication with an electronic drilling recorder (EDR) system 206 of the drilling system. The EDR system is in communication with a variety of sensors that are located on the rig and collects data from the sensors. The onsite device 202 may be wiredly or wirelessly coupled to the EDR system 206 in, for example, a local communication network at the drilling site.

In some embodiments, the onsite device 202 is configured to host software programs and/or applications for managing the PMA 122 ("PMA software 212"). In some embodiments, the onsite device 202 may operate the PMA software 212 locally or within a local network at the drilling site. The PMA software 212 can access data collected by the sensors and flowmeter of the PMA 122 via the control unit 170. The PMA software 212 can also send electronic communications (e.g., commands, data, etc.) to the control unit 170 to cause the control unit 170 to change one or more settings of the PMA 122. When the onsite device 202 is connected to the EDR system 206, the PMA software 212 can access the data of the sensors on the rig. In some embodiments, the PMA software 212 can send communications (e.g., data) to the EDR system. The data provided to the PMA software 212 by the control unit 170 and the EDR system may be direct data captured by the sensors and flowmeter or may be processed prior be being received by the PMA software 212.

In some embodiments, the PMA software 212 can send and receive communications to and from the network 222. In some embodiments, the PMA software 212 is configured to communicate with and control aspects of the PMA 122 via the control unit 170 and to communicate with the offsite devices 204 via network 222. In additional or alternative embodiments, at least some of the PMA software 212 may be stored on the servers 224. In some embodiments, the servers 224 may receive data from the PMA software 212, store the received data, and perform analysis on the received data. Based on the analysis, the servers 224 may send communications to one or both of the onsite device 202 and offsite devices 204.

In some embodiments, with reference to FIGS. 1 and 3, by exchanging communications with the control unit 170 and, optionally, the EDR system 206, the PMA software 212 of the onsite device 202 is configured to allow an operator to monitor and control the PMA 122 during a drilling operation, which may include one or more of, e.g., drilling of the wellbore 16, connection of the drill string 14, tripping out of the drill string 14, circulation of fluid in the wellbore 16, reaming of the wellbore 16, handling of a kick or a loss while drilling the wellbore 16, and any offline operation. In some embodiments, the PMA software 212 provides a platform for monitoring all the sensors in the PMA 122 (and optionally the sensors of the EDR system) and for controlling the settings of various components in the PMA 122. In some embodiments, the onsite device 202 can store the data collected from the control unit 170 and optionally the EDR system. In some embodiments, the PMA software 212 can receive user input from the operator via the user interface to adjust one or more settings of the PMA 122. Upon receipt of the user input, the PMA software 212 generates an appropriate command and sends the command to the control unit 170. Where a command is generated by the PMA software 212 based on user input, the command is referred to as "manually obtained".

In some embodiments, based at least in part on the collected data, the PMA software 212 can perform various analysis on the operational parameters of the drilling system and accordingly send commands to the control unit 170 of the PMA 122 to obtain the desired parameters for the drilling operation. Where a command is generated by the PMA software 212 based on analysis performed by the PMA software 212, the command is referred to as "self-generated". Commands for the PMA 122 can thus be obtained manually or self-generated by the PMA software 212 with an automated sequence of actions. Whether manually obtained or self-generated, the commands may be sent by the PMA software 212 to the control unit 170 to adjust the settings of the PMA 122 to, for example, manage the wellbore pressure during drilling. In one example, the PMA software 212 may signal the control unit 170 to change the position of one or both of the chokes 130*a*,130*b*.

In some embodiments, the PMA software 212 may include pre-set rules that dictate acceptable values for the monitored variables, for example, acceptable ranges. In some embodiments, the pre-set rules may be generated by the PMA software 212 based on its own analysis. In additional or alternative embodiments, the pre-set rules are based on user input and/or can be modified by user input. In some embodiments, based on the data provided by the control unit 170, if the PMA software 212 determines that any of the pre-set rules is broken, the PMA software 212 may prompt the operator for user input by sending out an alert, such as a pop-up box in the display of the onsite device 202, a text or email message to the operator, or other methods known to those in the art. In alternative or additional embodiments, upon determining that a pre-set rule has been broken, the PMA software may send a self-generated command to the control unit 170 to correct the problem.

In some embodiments, the PMA software 212 may employ real-time hydraulics, Torque and Drag (T&D), and/or Wellbore Stability (WBS) models. In some embodiments, the PMA software 212 provides real-time analysis and future drilling event predictions. By monitoring data provided by the control unit 170 and optionally the EDR system 206, the PMA software 212 may predict future drilling problems and events before they manifest themselves. For example, the PMA software 212 may provide real-time hydraulics analyses and control using algorithms that include the effects of temperature and pressure on downhole fluid hydraulics.

With reference to FIGS. 2 and 3, in some embodiments, based on the data provided by the control unit 170 of the PMA 122 and the EDR system 206, the PMA software 212 of the onsite device 202 can monitor the flow rate of fluids entering the PMA 122 (measured by flowmeter 128), the injection pressure (or standpipe pressure) provided by the EDR system 206, the surface backpressure (measured by the pressure sensor 124), the position of the chokes 130*a*,130*b* (determined by position sensors 132*a*,132*b*), and the mud density of the drilling fluid (measured by the flowmeter 128). By monitoring for any deviations in these variables, the PMA software 212 can identify fluid influxes into the wellbore from the formation and losses of drilling mud into the formation in real-time. Upon detecting such influxes or losses, the PMA software 212 can automatically send the necessary commands to the control unit 170 to control or correct the influxes or losses or may prompt the operator of the onsite device 202 for specific user input by sending an alert.

In some embodiments, by monitoring for deviations in the above-mentioned variables, the PMA software 212 can detect choke plugging or other choke failures. Upon detecting such failures, the PMA software 212 can automatically send commands to the control unit 170 to mitigate against such failures or may prompt the operator for user input. For example, the PMA software 212 may send a command, whether manually obtained or self-generated, to the control unit 170 to place the failed choke offline and put the other choke online so that fluid can be redirected to the other choke. For example, if choke 130*a* is online and choke 130*b* is offline but the PMA software 212 detects failure in choke 130*a*, then the PMA software sends a command to the control unit 170 to cause the motor drive module 176 to drive choke valve motor 144*a* to place choke 130*a* offline (i.e., blocking fluid flow thereto) and to drive choke valve motor 144*b* to put choke 130*b* online so that fluid entering the PMA 122 is redirected to choke 130*b*.

In some embodiments, by monitoring the signals of the choke position sensors 132*a*,132*b* and the choke valve position sensors 134*a*,134*b*, the PMA software 212 can determine which choke(s) is online and how open the online choke(s) is. When the PMA software 212 (or the operator of the onsite device 202) determines that it is necessary to change the choke setting, the PMA can send a command to the control unit 170 to cause the motor drive module 176 to drive one or more of the choke motors 142*a*,142*b* and the choke valve motors 144*a*,144*b*. In one example, to open choke 130*a* further, the PMA software 212 sends a command to the control unit 170 to cause the motor drive module 176 to drive choke motor 142*a*. In another example, to redirect fluid from one choke 130*a* to another choke 130*b*, the PMA software 212 sends a command to the control unit 170 to cause the motor drive module 176 to drive both choke valve motors 144*a*,144*b*, with the motor 144*a* placing choke 130*a* offline while the motor 144*b* puts choke 130*b* online.

Before drilling begins, the bearing assembly is first secured to the bowl of the RCD module 160. In some embodiments, the PMA software 212 can facilitate the process of securing the bearing assembly to the bowl by monitoring the signal of the position sensor 162 and, optionally, images or footages captured by the camera 180 to determine whether the bearing assembly is secured to the bowl. For example, upon determining that the bearing assembly is not yet secured to the bowl, the PMA software 212 may send a command to the control unit 170 to cause the motor drive module 176 to drive the latching motor 164 to move the bearing assembly relative to the bowl.

Figure 4:
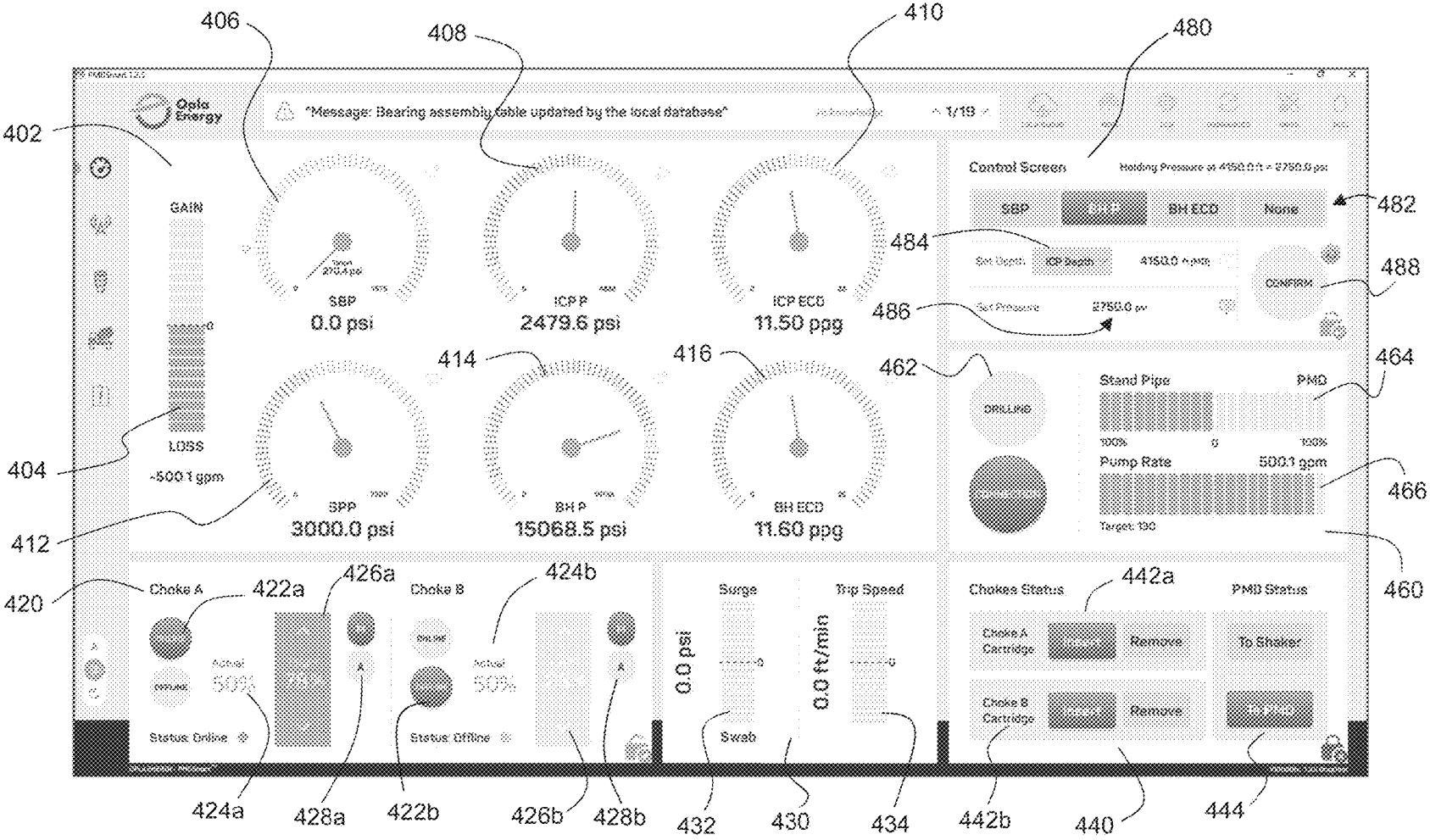
FIG. 4 is a sample control panel screen for a user interface of an onsite device of the control system, according to one embodiment of the present disclosure.

FIG. 4 shows a sample control panel 400 provided by the PMA software 212, which can be accessed by an operator via the display of the user interface of the onsite device 202. The control panel 400 may be configured to display the monitored variables in real-time and to enable the operator to control the settings of the PMA in real-time. In the illustrated embodiment, the control panel 400 comprises a pressure section 402, a choke section 420, a surge/swab section 430, a status section 440, a current operation section 460, and a control section 480.

In some embodiments, the pressure section 402 has a gain/loss gauge 404 showing any drilling fluid gain or loss in the drilling system, a surface backpressure (SBP) gauge 406 showing the real-time surface backpressure, an intermediate casing point (ICP) pressure gauge 408, an ICP equivalent circulating density (ECD) gauge 410 showing the ICP pressure as a density value, a standpipe pressure (SPP) gauge 412, a bottomhole pressure (BHP) gauge 414 showing the real-time bottomhole pressure in the wellbore, and a bottomhole equivalent circulating density (BH ECD) gauge 416 showing the bottomhole pressure as a density value. The real-time surface backpressure may be the pressure as measured by pressure sensor 124 (FIG. 2) of the PMA 122, which is communicated to the PMA software by the control unit 170. The real-time bottomhole pressure may be calculated by the PMA software based on one or more variables such as well profile, drill string profile, surface backpressure, mud density, mud properties, drilling fluid pump rate, drill string rpm, bottomhole temperature, drilling mud surface temperature, surge and swab effect based on drill string movement, drilling mud column (drilling mud profile) in the annulus, etc., by methods known to those skilled in the art. In the illustrated embodiment, gauge 404 is shown as a vertical bar graph display and gauges 406 to 416 are each shown as a dial indicator display. In some embodiments, each dial indicator display may have color-coded portions to indicate a safe/optimal range and an unsafe/undesirable range.

In other embodiments, not shown here, the pressure section 402 is configured to display alternative or additional gauges to show other wellbore data such as, for example, annular friction losses, custom depth ECD, custom depth pressure, etc.

In some embodiments, the choke section 420 displays the current operational status of each choke in the drilling system. For example, in the illustrated embodiment, the drilling system has two chokes: choke A and choke B. The choke section 420 can show the status of each choke, i.e., whether each choke is online or offline via choke status indicators 422*a*,422*b*. For example, in FIG. 4, the choke status indicator 422*a* shows that choke A is online while choke status indicator 422*b* shows choke B as being offline. In some embodiments, each of the indicators 422*a*,422*b* has interactive buttons that allow the operator to set the corresponding choke as online or offline. Depending on the setting selected by the operator, the PMA software can generate and send the necessary commands to the control unit 170 to cause one or both of the choke valve motors (e.g., choke valve motors 144*a*,144*b* in FIG. 2) to adjust one or both of the choke valves of chokes A and B to match the setting selected by the operator.

The choke section 420 may also show how open each choke is by choke position indicators 424*a*,424*b*. For example, in FIG. 4, choke position indicator 424*a* shows that choke A is 50% open while choke position indicator 424*b* also shows choke B as being 50% open. In choke section 420, each choke may have a respective choke position adjuster 426*a*,426*b* and each choke position adjuster may have a respective mode indicator 428*a*,428*b* showing whether the corresponding adjuster 426*a*,426*b* is in a manual mode or automatic mode. When a choke is online (e.g., choke A in FIG. 4), a target openness of the choke can be set using the corresponding choke position adjuster (e.g., choke position adjuster 426*a*). If the choke position adjuster 426*a* is in the manual mode, the target openness of the corresponding choke (choke A) can be set by the operator. If the adjuster 426*a* is in the automatic mode, the PMA software can set the target openness based on the data received from the control unit 170 of the PMA 122 and optionally the EDR system 206. In some embodiments, each of the mode indicators 428*a*,428*b* has interactive buttons that allow the operator to select either the manual mode or the automatic mode for the adjusters 426*a*,426*b*. In some embodiments, when the automatic mode is selected, the PMA software reacts by locking the corresponding adjuster 426*a*,426*b* so that the operator cannot modify the target openness of that adjuster. In the sample embodiment shown in FIG. 4, choke A is 89% open and the target openness is set to 80% in the adjuster 426*a* by the operator (since the adjuster 426*a* is in the manual mode as shown by indicator 428*a*). If the target openness is different from the actual openness indicated by indicator 424*a*, the PMA software can generate and send the necessary commands to the control unit 170 to cause the choke motor (e.g., choke motor 142*a* in FIG. 2) of choke A to open or close the choke until the actual openness of the choke reaches the target openness.

In some embodiments, the surge/swab section 430 has a trip speed gauge 434 showing the tripping speed of the drill sting 14. The surge/swab section 430 may also have a surge/swab gauge 432 showing the surge or swab pressure, which is calculated based on the tripping speed and other variables such as movement direction of the drill string, wellbore profile, drill string profile, drilling mud profile, drilling mud properties, drill string ending conditions, by methods known to those skilled in the art.

In embodiments where chokes A and B are cartridge-style chokes, the status section 440 has choke cartridge status indicators 442*a*,442*b* showing whether the respective choke cartridges of chokes A and B are inserted ("insert") into the corresponding choke housings or removed ("remove") from the corresponding choke housings. In some embodiments, each of the indicators 442*a*,442*b* has interactive buttons that allow the operator to set the choke cartridge status (i.e., insert or remove) of the corresponding choke. Based on the operator's selection, the PMA software may generate and send the necessary commands to the control unit 170 to change the settings of the PMA to match the operator's selection.

For example, with further reference to FIGS. 2 and 3, if the operator selects "remove" for choke A (e.g., choke 130*a* in FIG. 2), the PMA software 212 may send a command to the control unit 170 to cause the control unit 170 to check whether choke 130*a* is offline based on the signal from the choke valve position sensor 134*a*. If choke 130*a* is not offline, the control unit 170 may send a signal to the motor drive module 176 to cause the choke valve motor 144*a* to place choke 130*a* offline. If the control unit 170 confirms that choke 130*a* is offline, the control unit 170 may signal the motor drive module 176 to drive the choke cartridge motor 146*a* to remove the choke cartridge from the choke housing of choke 130*a*. Based on the signals from the choke cartridge position sensor 136*a*, the control unit 170 may confirm that the choke cartridge of choke 130*a* has been removed and in turn may communicate a confirmation to the PMA software 212. Upon receiving the confirmation, the PMA software 212 can update the status of choke 130*a* in indicator 442*a* of the control panel 400.

The status section 440 may also have a PMA status indicator 444 to show whether fluid is flowing through one or both of chokes A and B of the PMA (i.e., choke gut line of the PMA 122 is closed) or bypassing both of the chokes A and B of the PMA (i.e., choke gut line is open). In the illustrated embodiment, if fluid is flowing through one or both of chokes A and B, the PMA is in the "to PMD" mode shown in the PMA status indicator 444. If fluid is bypassing both chokes A and B, the PMA is in the "to shaker" mode shown in the PMA status indicator. With further reference to FIG. 1, the shaker (not shown) is part of the mud handling equipment 50. "To shaker" indicates that fluid entering the PMA is flowing to the mud handling equipment 50 without first flowing through either choke A or choke B. In some embodiments, the indicator 444 has interactive buttons that allow the operator to select the "to PMD" or the "to shaker" mode. Based on which button of the indicator 444 the operator selects, the PMA software generates and sends the necessary commands to the control unit 170 to change the settings of the PMA to match the operator's selection.

For example, with further reference to FIGS. 2 and 3, if the operator selects the "to shaker" mode, the PMA software 212 may send a command to the control unit 170 to cause same to check whether the choke gut line of the PMA 122 is open and whether chokes A and B (e.g., chokes 130*a*, 130*b*, respectively) are offline based on the signals from the flowline valve position sensor 152 and the choke valve position sensors 134*a*,134*b*, respectively. If the choke gut line is open and chokes 130*a*,130*b* are offline, the control unit 170 may communicate same to the PMA software and the PMA software may confirm same to the operator via control panel 400. If the choke gut line is closed and one or both of chokes 130*a*,130*b* are online, the control unit 170 may then send a signal to the motor drive module 176 to drive the flowline valve motor 154 to cause the position of the flowline valve 150 to change, thereby opening the choke gut line, and to drive one or both of the choke valve motors 144*a*,144*b* to render the chokes 130*a*,130*b* offline. Based on the signals from the flowline valve position sensor 152 and the choke valve position sensors 134*a*,134*b*, the control unit 170 may confirm that the PMA is in the "to shaker" mode and communicate a confirmation to the PMA software 212. Upon receiving the confirmation, the PMA software 212 can update the status of the PMA in indicator 444 of the control panel 400.

If the operator selects the "to PMD" mode, the PMA software 212 may send a command to the control unit 170 to cause same to check whether the choke gut line of the PMA 122 is closed and whether one or both chokes 130*a*, 130*b* are online based on the signals from the flowline valve position sensor 152 and the choke valve position sensors 134*a*,134*b*, respectively. If the choke gut line is closed and one or both chokes 130*a*,130*b* are online, the control unit 170 may communicate same to the PMA software and the PMA software may confirm same to the operator via control panel 400. If the choke gut line is open and both chokes 130*a*,130*b* are offline, the control unit 170 may then send a signal to the motor drive module 176 to drive the flowline valve motor 154 to cause the position of the flowline valve 150 to change, thereby closing the choke gut line, and to drive one or both of the choke valve motors 144*a*,144*b* to render one or both chokes 130*a*,130*b* online. Whether the control unit 170 places one or both of the chokes online may depend on user settings in the PMA software 212. Based on the signals from the flowline valve position sensor 152 and the choke valve position sensors 134*a*,134*b*, the control unit 170 confirms that the PMA is in the "to PMD" mode and communicates a confirmation to the PMA software 212. Upon receiving the confirmation, the PMA software 212 can update the status of the PMA in indicator 444 of the control panel 400.

In some embodiments, the current operation section 460 has an operation indicator 462 that shows whether the current operation of the drilling system is drilling of wellbore or connection of new segments of the drill string. In some embodiments, the indicator 462 has interactive buttons that allow the operator to select the current operation of the drilling system. Depending on which button is selected in indicator 462, the PMA software may generate and send commands to the control unit 170 to change the settings of the PMA to match the operator's selection.

For example, if the operator selects "connection," the PMA software may send a command to the control unit 170 and then the control unit 170 may send a signal to the motor drive module 176 to drive the choke motor 142*a*,142*b* of the online choke(s) to adjust the openness of the choke to compensate for changes in annular friction losses in the wellbore during connection of new drill string segment. If the operator selects "drilling," the PMA software may send a command to the control unit 170 and then the control unit 170 sends a signal to the motor drive module 176 to drive the choke motor 142*a*,142*b* of the online choke(s) to adjust the openness of the choke to compensate for changes in annular friction losses in the wellbore after the connection of new drill string segments is completed and the pumping of drilling fluid into the wellbore resumes. In either situation, the amount of adjustment required to the openness of the online choke(s) may be determined automatically by the PMA software.

In some embodiments, the current operation section 460 also has a standpipe/PMA gauge 464 and a pump rate gauge 466. In FIG. 4, the standpipe/PMA gauge 464 shows an ideal pump rate for diverting flow without exceeding surface limitations of a pump diverter device (not shown) in the drilling system, from downhole (standpipe) to across the PMA, to provide continued circulation during the connection of new drill string segments, so that chokes 130*a*,130*b* can attain a desired bottomhole pressure under no flow conditions downhole. The pump rate gauge 466 may shows the pump rate of the mud pump 60 as measured by the sensors in the EDR system.

In some embodiments, the control section 480 has a control screen indicator 482 which provides 4 different modes of pressure control for the drilling system. The control section 480 may also have a set depth indicator 484 showing the depth value of a particular set depth. The set depth indicator 484 has a drop-down menu that allows the operator to select the type of set depth to show (e.g., ICP depth). The control section 480 may have a pressure value input 486 with an input box that allows the operator to input a pressure value. In the illustrated embodiment, the 4 modes of pressure control include: an SBP mode; a BHP mode; a BH ECD mode; and a "none" mode. The control section 480 may have an interactive button 488 to allow the user the confirm the selections made in the control section 480. Based on the selections made by the operator in the control section 480, the PMA may software generate and send commands to the control unit 170 accordingly.

For example, in the SBP mode, the operator can set a pressure value ("static SBP") in the input box of the pressure value input 486 and the PMA software 212 communicates with the control unit 170 to cause the PMA 122 to apply the static SBP (e.g., 200 psi) on the wellbore regardless of the pump rate of the mud pump 60 or downhole pressure conditions in wellbore 16. In the BHP mode, the operator can select a type of set depth from the drop-down menu of the set depth indicator 484 and a pressure valve ("desired BHP") in the pressure value input 486. The PMA software then communicates with the control unit 170 to cause the PMA 122 to manipulate the desired BHP at the selected set depth (e.g., 2750.0 psi at the ICP depth of 4150.0 ft) by applying a backpressure at surface. In the BHP mode, the necessary surface backpressure applied by the PMA 122 may be calculated based on variables such as pump rate of the mud pump, drilling mud profile, drilling mud properties, etc. The necessary surface backpressure may change constantly to maintain the desired BHP at the set depth. In the BH ECD mode, the operator can select a particular set depth from the drop-down menu of the set depth indicator 484 and, instead of a pressure value, the operator can insert an ECD value ("desired ECD") in the input box of the pressure value input 486. The PMA software may then communicate with the control unit 170 to cause the PMA 122 to manipulate the desired ECD at the set depth by applying a backpressure at surface. In the "none" mode, the PMA software may automatically open the chokes 130*a*,130*b* fully to release any surface backpressure applied in the previous mode (i.e., SBP, BHP, or BH ECD).

Referring back to FIG. 3A, the at least one offsite communication device 204 of the control system 100 is located at a remote location some distance away from the drilling site. While the illustrated embodiment shows two offsite devices, the control system 100 may have fewer or more offsite devices in other embodiments. In some embodiments, the offsite device 204 comprises one or more processors and storage medium. In some embodiments, the offsite device 204 has a user interface and hosts one or more applications. In some embodiments, the offsite device 204 can receive user input via an input device such as a touch screen, mouse, keyboard, etc. In some embodiments, the offsite device 204 is a portable device having wireless communication capabilities, such as for example, a smart phone, a laptop, a tablet, or other portable devices capable of communicating over the network 222 and displaying information. In embodiments where the control system 100 has two or more offsite devices, the two or more offsite devices 204 may be the same or may include different types of devices. In further embodiments, the two or more offsite devices 204 may be in different geographical locations but can all communicate with the onsite device 202 at the same drilling site via the network 222.

In some embodiments, the offsite device 204 has a PMA application 214, i.e., software/firmware program running thereon, to enable a user interface and features, which will be described below in more detail. The offsite device 204 may load or install the PMA application 214 based on data received over the network 222. In some embodiments, the PMA application 214 may be configured to run on portable devices platforms, such as iPhone, iPod touch, Blackberry, Google Android, Windows Mobile, etc. In some embodiments, the PMA application 214 can send communications to and receive communications from the PMA software 212 over the network 222. In some embodiments, the PMA application 214 can receive data collected by the PMA software 212 of the onsite device 202 in a real-time feed via one or more data channels on the network 222. In some embodiments, the PMA application 214 allows the operator of the offsite device 204 to download the data received from the PMA software 212 for subsequent viewing and/or analysis. In some embodiments, the PMA application 214 can receive user input from the operator of the offsite device 204 via the user interface and, based on the user input, send communications to the PMA software 212. In some embodiments, the PMA software 212 can send communications (e.g., alerts) to the PMA application 214 based on the data provided by control unit 170 and/or data analysis performed by the PMA software 212.

In some embodiments, when the offsite device 204 is connected to the onsite device 202, the PMA application 214 can provide the same functionalities as the PMA software 212 but from a distant location from the PMA 122. In some embodiments, the PMA application 214 has real-time access to the same data received by the PMA software and the PMA application 214 can self-generate or manually obtain (i.e., via the user interface) a command and then send the command to the PMA software via the network 222. Once received, the PMA software may forward the command to the control unit 170 of the PMA 122 to change one or more settings of the PMA, as described above. The command sent by the PMA application 214 and forwarded to the control unit 170 by the PMA software may have the same effect on the PMA 122 as a command that is self-generated or manually obtained by the PMA software 212 itself.

The PMA application 214 may be configured to allow an operator of the offsite device 204 to access the PMA software 212 of the onsite device 202, and the data collected by the PMA software 212, such that the operator may remotely monitor and control the PMA 122, or aspects thereof, of the drilling site from anywhere that the offsite device 204 can access the network 222. In some embodiments, the PMA application 214 allows the offsite device 204 to connect to the PMA 122 remotely, via the network 222 and onsite device 202, and provide the operator of the offsite device 204 with real-time, remote control of the PMA 122. In some embodiments, the PMA application 214 on offsite device 204 operates as a long-range remote control that can work from anywhere in the world for long-range wireless protocols (e.g., GSM, CDMA, WiMax, etc.) via remote servers, such as servers 224.

In some embodiments, based on user settings in the PMA application 214, the PMA application 214 may automatically change one or more settings of the PMA 122 on the operator's behalf in response to changes in the received data and/or alerts from the PMA software 212. In some embodiments, the PMA application 214 may define pre-set rules for controlling the PMA 122. The pre-set rules may be based on user input by the operator of the offsite device 204 or self-generated by the PMA application 214. In some embodiments, the pre-set rules dictate an acceptable range for each monitored variable. For example, one of the pre-set rules may dictate a maximum bottomhole pressure and a minimum bottomhole pressure set by the operator. When the real-time bottomhole pressure is not between the minimum and maximum bottomhole pressure values of the pre-set rule, the PMA application 214 may automatically communicate with the PMA software 212 of the onsite device 202 to cause the control unit 170 to adjust one or both of the chokes 130*a*,130*b* accordingly.

Figure 5A:
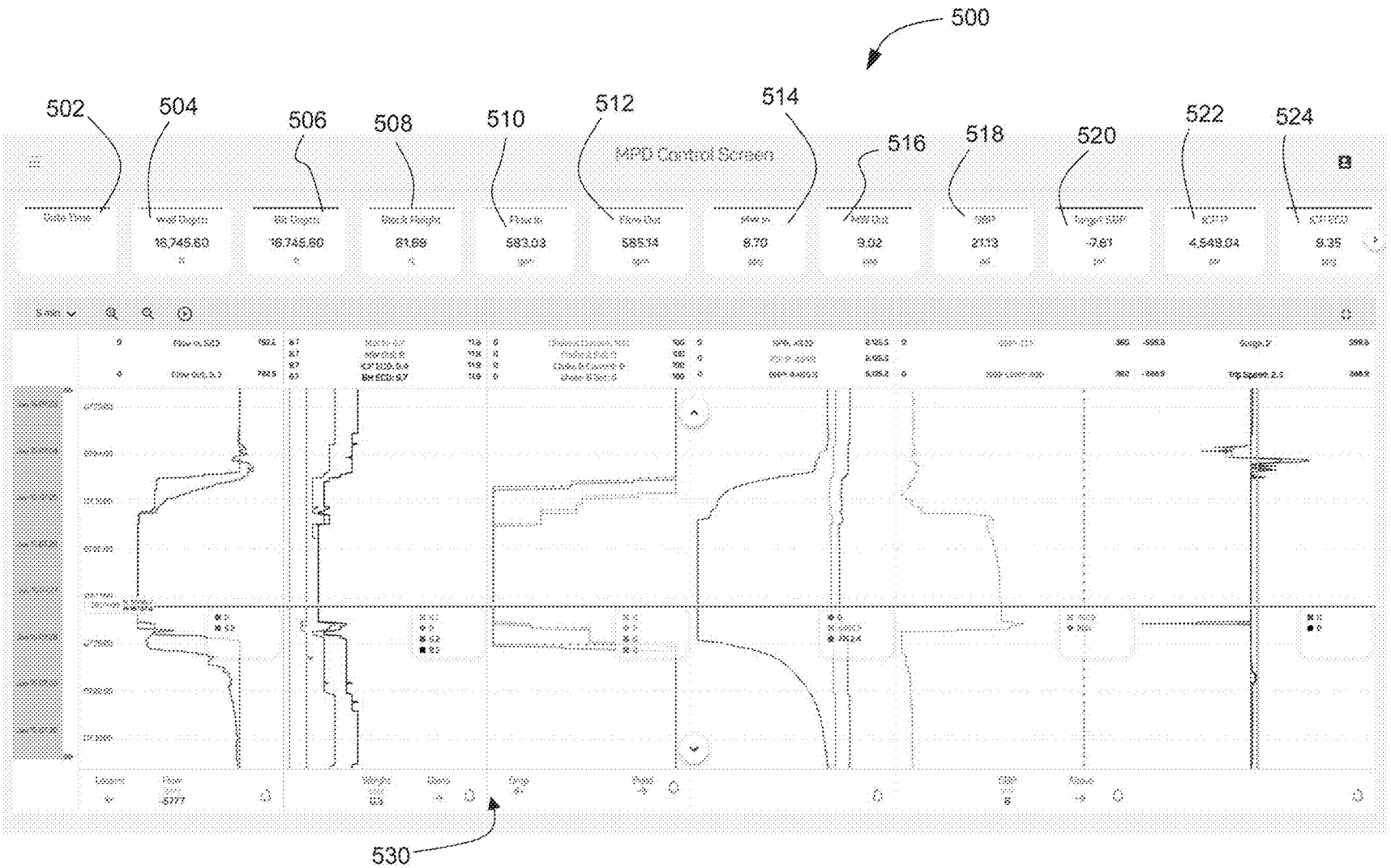
FIG. 5A is a sample control panel screen for a user interface of an offsite device of the control system, according to one embodiment of the present disclosure.

FIG. 5A shows a sample control panel 500 provided by the PMA application 214, which can be accessed by an operator via the user interface of the offsite device 204. In some embodiments, the PMA application 214 of the offsite device 204 exchanges communications with the PMA software 212 of the onsite device 202 over the network 222. Based on the communications from PMA software 212, the PMA application 204 generates and updates the control panel 500. In some embodiments, the control panel 500 is configured to display one or more monitored variables in real-time, as provided by the PMA software 212, and to enable the operator of the offsite device 204 to control the settings of the PMA 122 in real-time, over the network 222.

In the illustrated embodiment, the control panel 500 has a date and time indicator 502, a hole depth indicator 504 showing the real-time depth of the wellbore being monitored, and a bit depth indicator 506 showing the real-time depth of the drill bit in the wellbore. In some embodiments, the control panel 500 also has a block height indicator 508 showing the remaining length until the next drill string segment connection, a flow in indicator 510 showing the pump rate of the drilling fluid, a flow out indicator 512 showing the flow rate of drilling mud entering the PMA, a mud weight (MW) in indicator 514 showing the mud weight of the drilling fluid entering the wellbore, and a MW out indicator 516 showing the mud weight of the drilling mud exiting the wellbore. In some embodiments, the control panel also has a surface backpressure (SBP) indicator 518 showing the real-time surface backpressure and a target SBP indicator 520 showing a target SBP value. In some embodiments, the control panel has a ICP pressure indicator 522, and a ICP ECD indicator 524.

In some embodiments, the control panel 500 has a graph section 530 to provide a graphical representation of one or more of the above-mentioned variables. In further embodiments, the graph section 530 allows the operator to select specific block heights and displays the graphical representation of the one or more variables for the selected block heights. In some embodiments, the graph section 530 may show other variables such as bottomhole pressure, bottomhole ECD, the openness and status of choke A and choke B, surface backpressure, surface backpressure limit, surge pressure, trip speed, etc.

Figure 5B:
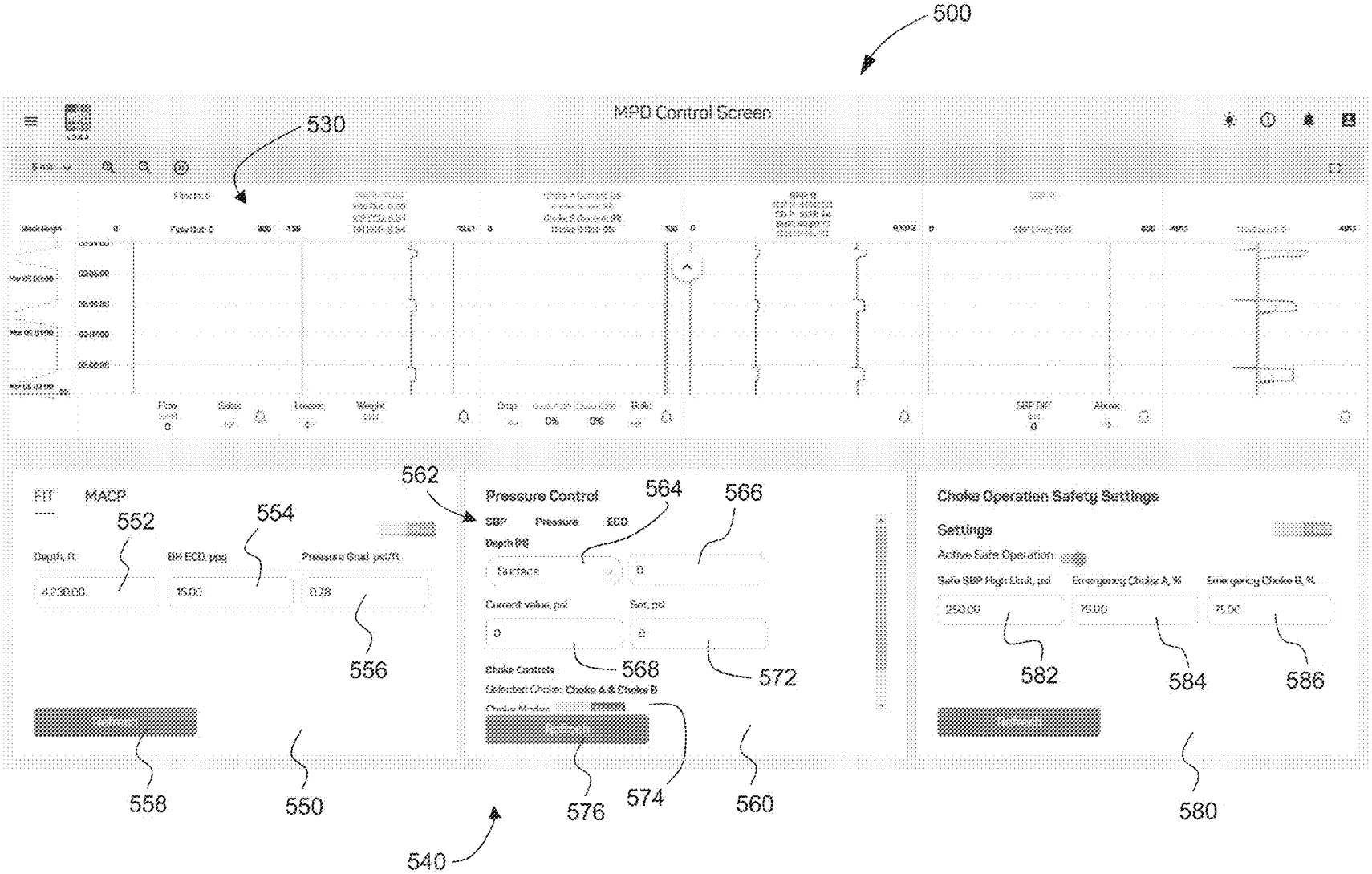
FIG. 5B is an alternative embodiment of the control panel of FIG. 5A.

With reference to FIG. 5B, in some embodiments, the control panel 500 comprises a control section 540 with one or more input boxes for receiving user input to enable the operator to adjust the settings of the PMA. In the illustrated embodiment, the control section 540 has a formation integrity test (FIT)/maximum allowable casing pressure (MACP) section 550, in which the operator can enter one or more of the depth in input box 552, the bottomhole ECD in input box 554, and the pressure gradient in input box 556. Section 550 may include a refresh button 558 for the operator to click on after modifying one of input boxes 552,554,556 so that the real-time values are displayed in this section.

In the illustrated embodiment, the control section 540 has a pressure control section 560, in which the operator can select the desired mode of pressure control for the drilling system in area 562. The pressure control section 560 may also have a drop-down menu 564 allowing the operator to select a depth level and the corresponding depth value for the selected depth level is shown in box 566. Box 568 may show the current pressure or ECD value and the operator can set the desired pressure or ECD value in input box 572. In the illustrated embodiment, the pressure control section 560 has a choke control section 574 through which the operator can select which choke to place online or offline, which mode (i.e., manual or automatic) each choke operates under, the openness of each choke, etc. After changing the value in one or more input boxes in section 560, the operator can click on a refresh button 576 in section 560 to display the real-time values in this section.

In the illustrated embodiment, the control section 540 has a choke operator safety settings section 580 that allows the operator to pre-set a safe SBP high limit in input box 582, an emergency choke openness for choke A in input box 584, and an emergency choke openness for choke B in input box 586. These values may be considered as pre-set rules.

Other configurations of the control panel 500 of the PMA application 214 are possible. In some embodiments, one or more gauges, indicators, buttons, etc. of the control panel 400 of the PMA software and the corresponding functions thereof may also be included in the control panel 500. In one embodiment, the control panel 500 may appear the same as or similar to the control panel 400.

When the operator modifies any of the input boxes, including the drop-down menu, in the control section 540, the PMA application 214 of the offsite device 204 can send a command to the PMA software 212 of the onsite device 202 via the Internet. In some embodiments, the PMA application 214 may also self-generate a command automatically, for example, when a pre-set rule is broken, and send the command to the PMA software 212. When the PMA software 212 receives the command from the PMA application 214, the PMA software may treat the received command as if it is a command originating from the PMA software at the onsite device 202, such that the command from the PMA application 214 has the same effect on the PMA 122 as a command by the PMA software itself. Sample commands by the PMA software and their effects on the PMA are described above so they are not repeated here.

In some embodiments, the operator of the onsite device 202 or the operator of the offsite device 204 may determine how much control of the PMA 122 to give to the control system 100. In some embodiments, the types of operations that the control system 100 is permitted to automatically perform are predetermined based on user settings in the PMA software 212 and/or PMA application 214.

Figure 3B:
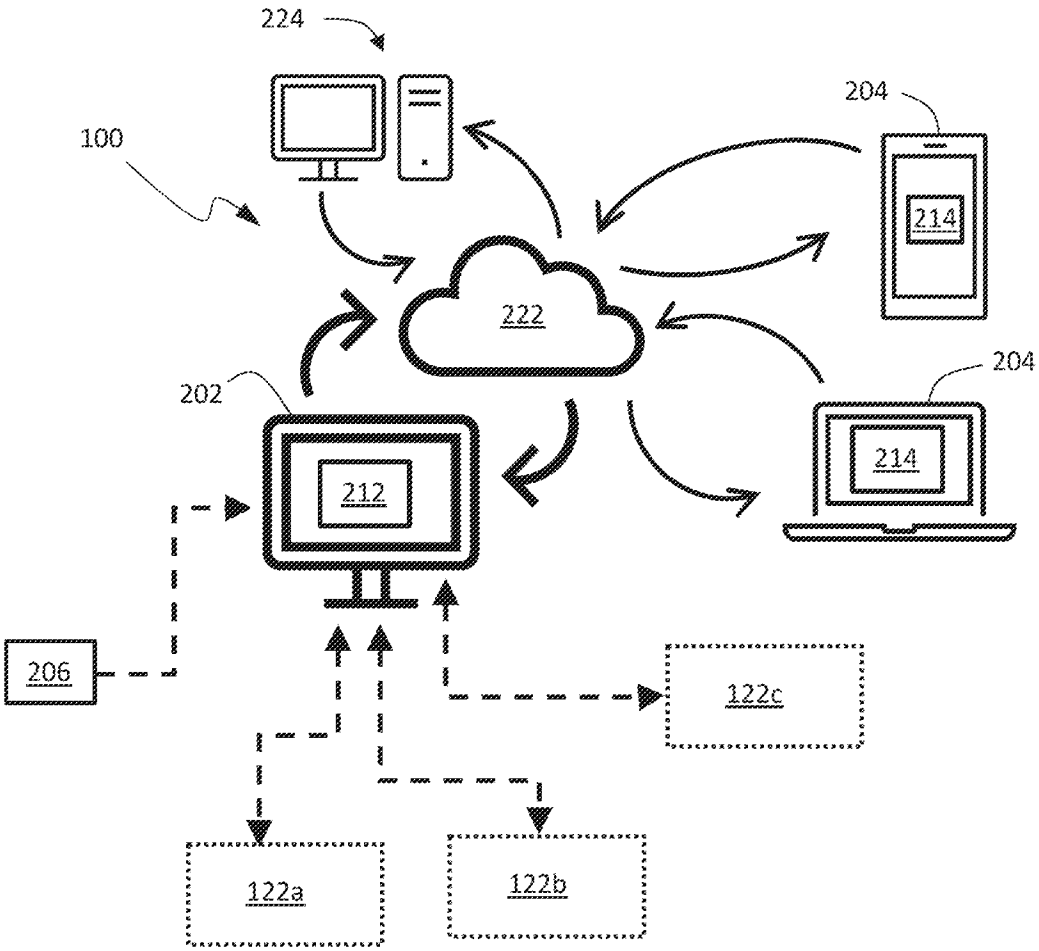
FIG. 3B is a schematic view of the control system, shown with its environment, according to another embodiment of the present disclosure.

While the illustrate embodiment in FIG. 3A shows one onsite device 202 in communication with one PMA 122 and one or more offsite devices 204 in communication with the onsite device 202 via the network 222, it can be appreciated that other configurations are possible. For example, as shown in FIG. 3B, the onsite device 202 may be in communication with multiple PMAs 122*a*,122*b*,122*c* at the same drilling site, and the PMA software 212 of the onsite device 202 is configured to enable the user to monitor and control one or more of the multiple PMAs simultaneously. The PMA application 214 of the offsite device 204 is configured to communicate with the onsite device 202 via the network 222 as described above, thus allowing the user of the offsite device to monitor and control all the PMAs 122*a*,122*b*,122*c* as well. PMAs 122*a*,122*b*,122*c* may each be the same as or similar to PMA 122 described above so PMAs 122*a*,122*b*,122*c* will not be described in detail herein. For simplicity, the components of the PMAs 122*a*,122*b*, 122*c* are omitted in FIG. 3B. In this embodiment, the control panel 500 of the offsite device 204 can be configured to show data of all the PMAs 122*a*,122*b*,122*c* simultaneously or allow the user to select which PMA's data to display. The user can thus monitor and control one or more of the PMAs 122*a*,122*b*,122*c* remotely via the control panel 500 of the offsite device 204.

Figure 3C:
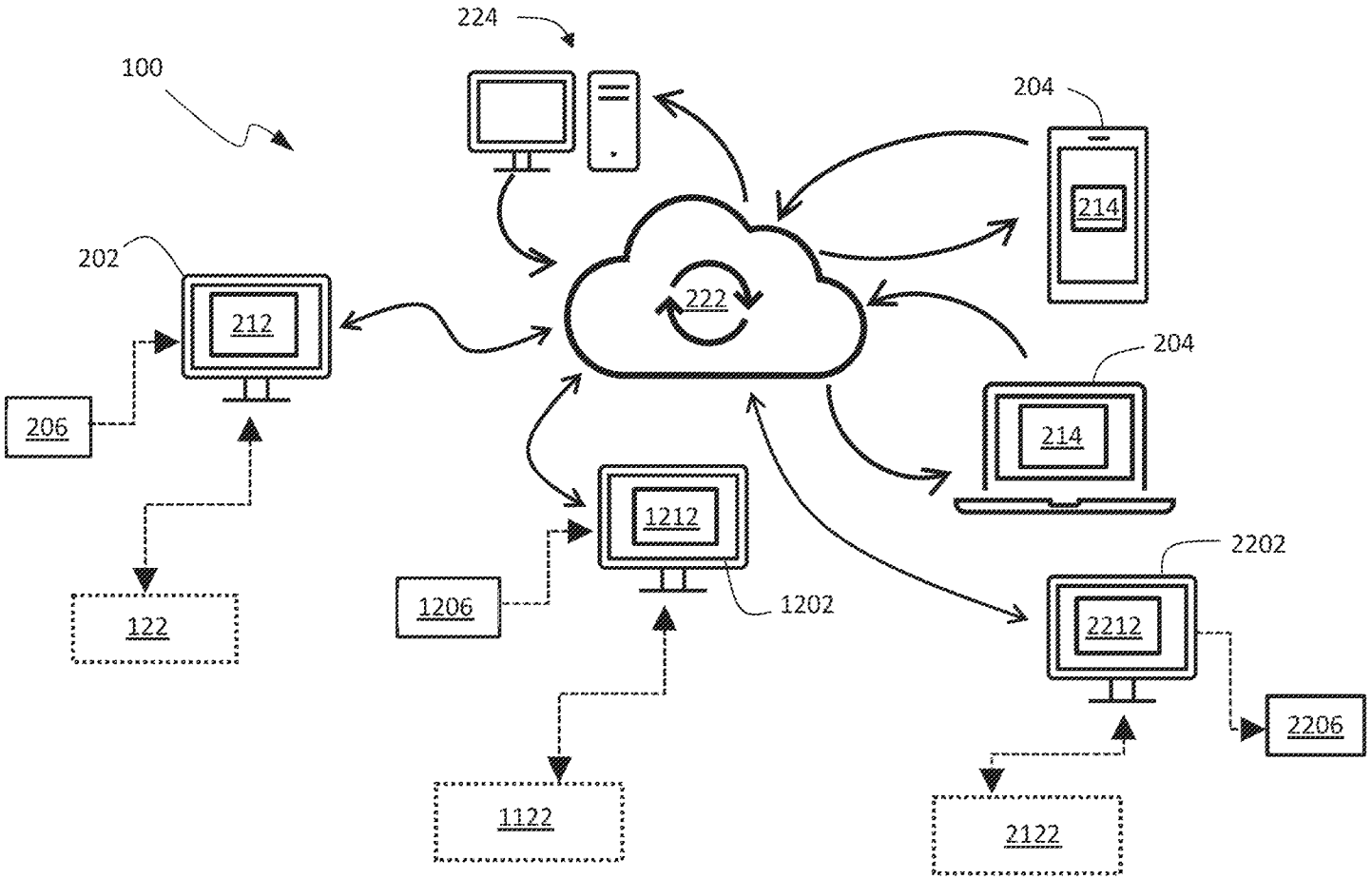
FIG. 3C is a schematic view of the control system, shown with its environment, according to yet another embodiment of the present disclosure.

In another example, as shown in FIG. 3C, there are multiple onsite devices 202,1202,2202, each being located at a respective drilling site and having a respective PMA software 212,1212,2212 installed thereon. PMA software 1212,2212 may be the same as or similar to PMA software 212 described above so PMA software 1212,2212 will not be described in detail herein. Each onsite device 202,1202,2202 is in communication with a respective PMA 122,1122,2122 at the respective drilling sites. PMAs 1122,2122 may each be the same as or similar to PMA 122 described above so PMAs 1122,2122 will not be described in detail herein. For simplicity, the components of the PMAs 122,1122,2122 are omitted in FIG. 3C. In some embodiments, each onsite device 202,1202,2202 is in communication with a respective EDR system 206,1206,2206 at each drilling site. The PMA application 214 of the offsite device is configured to communicate with each of the onsite devices 202,1202,2202 via the network 222, thus allowing the user of the offsite device 204 to monitor and control all the PMAs 122,1122,2122 across the multiple drilling sites simultaneously. In this embodiment, the control panel 500 of the offsite device 204 can be configured to show data of all the PMAs 122,1122, 2122 simultaneously or allow the user to select which drilling site's data to display. The user can thus remotely monitor and control one or more of the PMAs 122,1122, 2122 at the different drilling sites via the control panel 500 of the offsite device 204.

Figure 6:
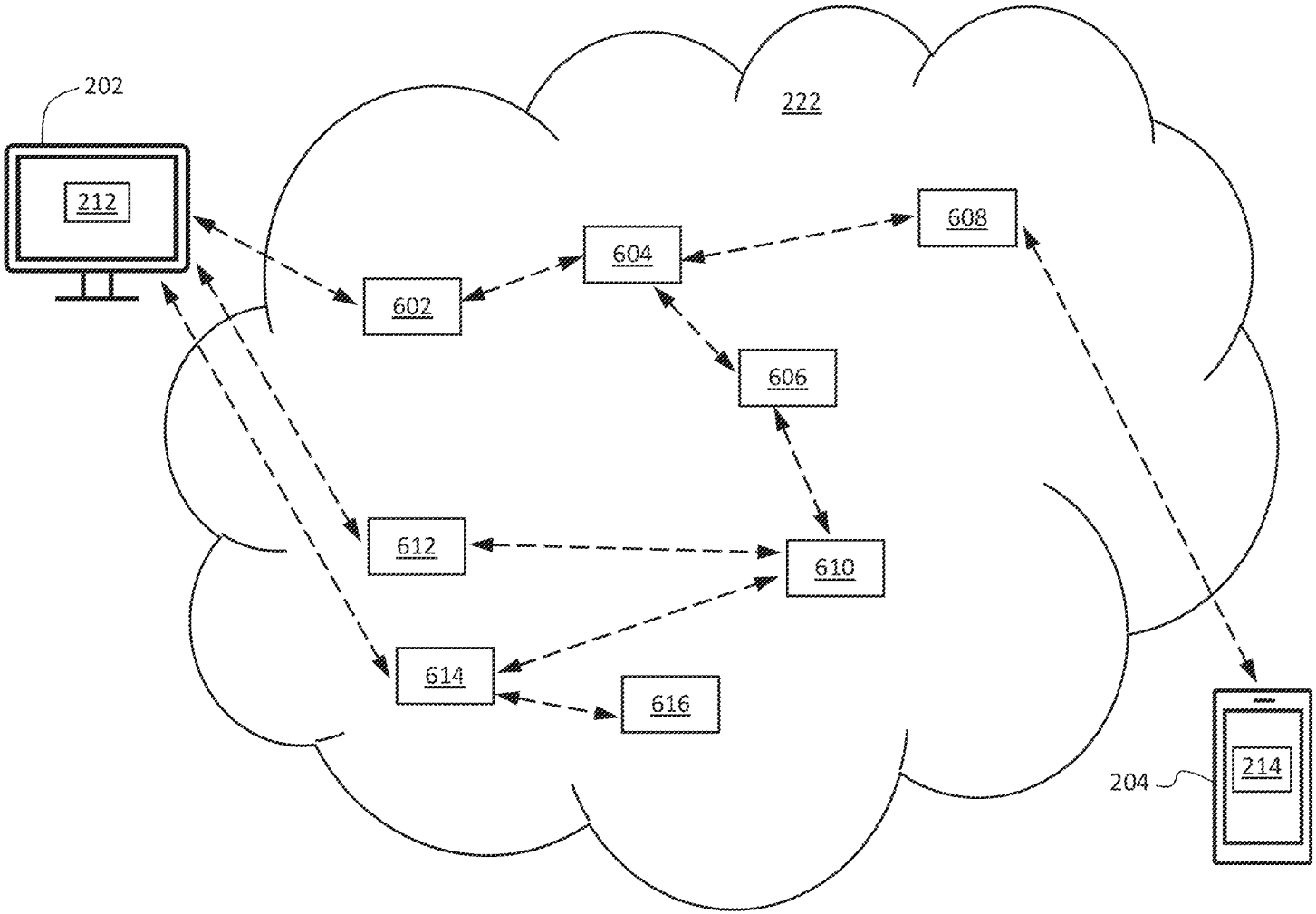
FIG. 6 is a schematic view of a sample configuration of a network of the control system, according to one embodiment of the present disclosure.

FIG. 6 shows a sample configuration of the network 222. In some embodiments, the network 222 comprises one or more of the following components: a proxy service 602; a managed clustered streaming service 604; a drilling data consumer 606; a streaming service for clients 608; a managed non-relational big database service 610; a software security service 612; a CREATE READ UPDATE DELETE (CRUD) service 614; and a user authentication proxy 616. Proxy service 602 acts as a proxy between the onsite device 202 and the other components in the network 222. Proxy service 602 may provide an entry point for the PMA software 212 on the onsite device 202 to access the data (e.g., drilling parameters) available on the network 222. An example of proxy service 602 is Lambda-Proxy®. Managed clustered streaming service 604 provides temporary storage for high volume traffic, which enables real-time streaming of large volumes of data. An example of managed clustered streaming service 604 is Managed Kafka® service. In some embodiments, communications from the onsite device 202 to proxy service 602 are forwarded to the managed clustered streaming service 604 for temporary storage. An example of the PMA software 212 is PMDSmart™ developed by Opla Energy.

Managed non-relational big database service 610 is a database that can provide permanent storage for large volumes of data. An example of database service 610 is Managed Cassandra® service. Drilling data consumer 606 may contain a number of stacks of backend applications that ingest data from the streaming service 604 and put the data into storage, which in this example is the database service 610. Streaming service for clients 608 may serve the offsite device 204 by reading data from the streaming service 604 and then sending the data to the PMA application 214 of the offsite device 204. In some embodiments, streaming service 608 forwards data in a neutral format that can be read by different types of devices. An example of streaming service for clients 608 is a cloud managed service such as Beanstalk® managed instance. An example of the PMA application 214 is PMDSmart™ developed by Opla Energy.

Security service 612 manages the security of the PMA application and PMA software, for example to ensure that only authorized users can access the data and software in the network 222. CRUD service 614 handles all tables from various applications and requests for historical data. CRUD service 614 may also provide authentication functions. User authentication proxy 616 is a forwarding mechanism between the components of the network 222 and an external authentication service (not shown). An example of the user authentication proxy is Okta®. Other configurations of the network 222 are possible.

Figure 7:
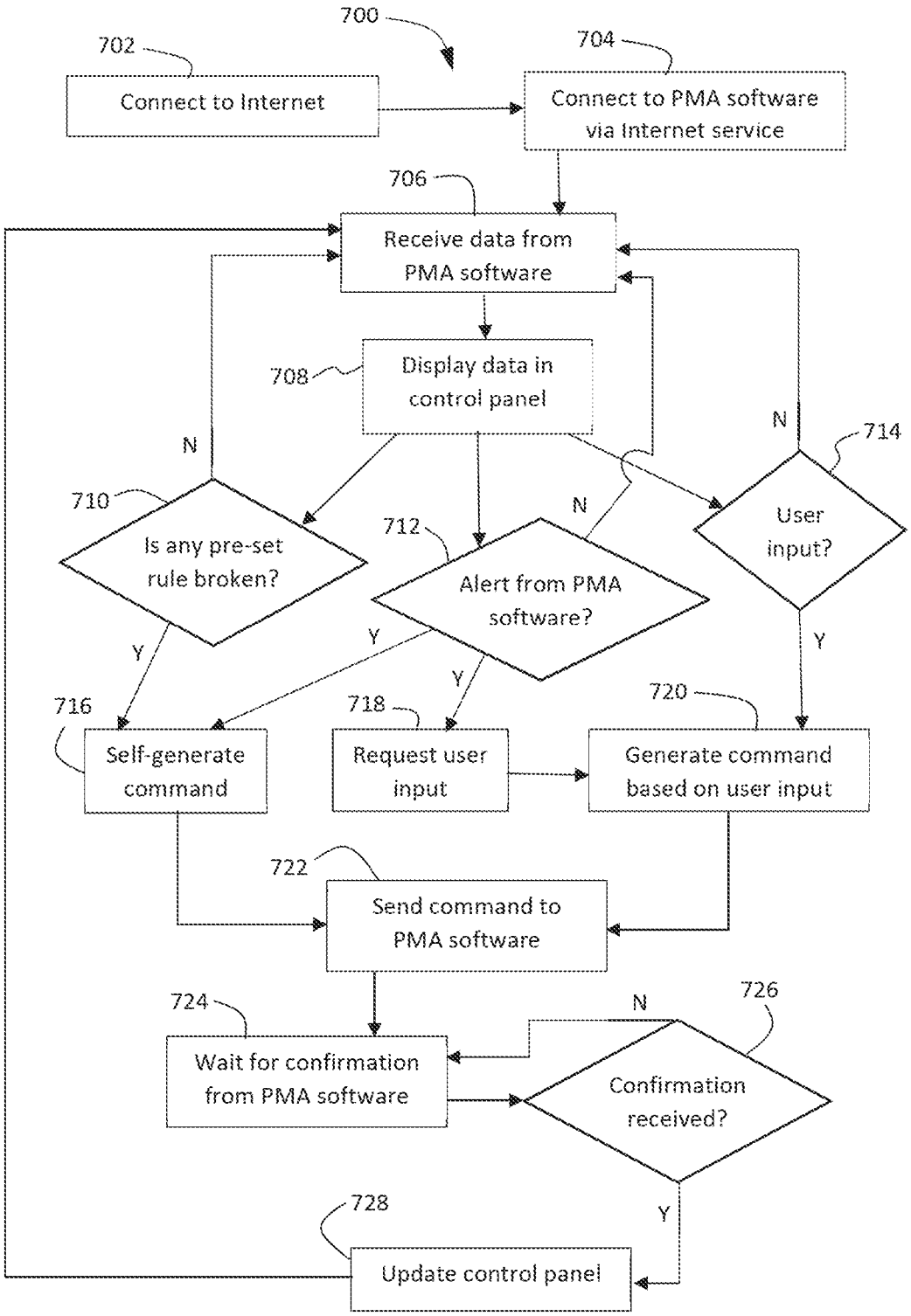
FIG. 7 is a flowchart of a sample process that can be performed by an offsite device of the control system, according to one embodiment of the present disclosure.
Figure 8:
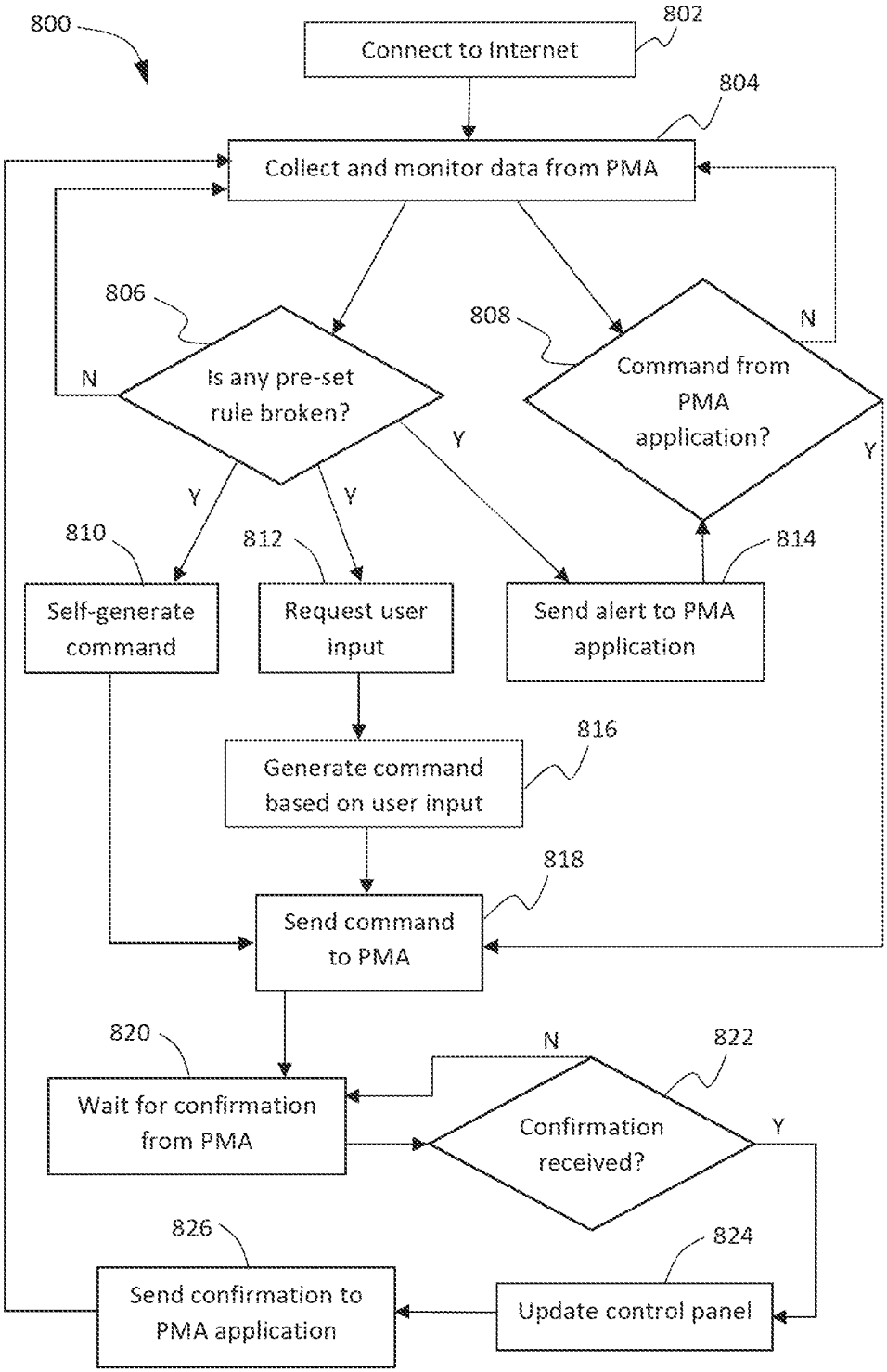
FIG. 8 is a flowchart of a sample process that can be performed by an onsite device of the control system, according to one embodiment of the present disclosure.

FIGS. 7 and 8 illustrate sample processes 700,800 that may be performed by the PMA application of the offsite device and the PMA software of the onsite device, respectively, of the control system 100. While the operations of the sample processes are described generally as being performed by the PMA application and/or the PMA software, it can be appreciated that the operations of the sample processes may be performed by the PMA application and/or the PMA software in combination with one or more other components in the control system 100.

With reference to FIG. 7, process 700 begins by the PMA application of the offsite device connecting to the Internet (step 702) and then connecting to the PMA software via an Internet service (step 704). Once connected, the PMA application begins to receive data from the PMA software (step 706) and displays the data in real-time on the control panel of the offsite device (step 708). As the PMA application continues to receive data and correspondingly display the data, the PMA application checks whether: (i) any of the pre-set rules in the PMA application is broken (step 710) based on the received data; (ii) it received an alert from the PMA software (step 712); and (iii) it received a user input (step 714).

Based on the data received from the PMA software, the PMA application may determine that a pre-set rule is broken (step 710) and then self-generates a command in response to the broken rule (step 716). If the PMA application receives an alert from the PMA software (step 712), the PMA application can either self-generate a command (step 716) or request user input from the operator of the offsite device (step 718). If the PMA application receives user input (step 714), whether the user input is in response to a request made under step 718 or is entered by the operator without being prompted, the PMA application may generate a (manually-obtained) command based on the user input (step 720). Not all user inputs received by the PMA application require a command be generated by the PMA application. Some user inputs, such as a request to modify the view of the control panel on the offsite device, do not require any action on the part of the PMA software or modification of PMA settings so the PMA application does not generate a command in these cases.

After the PMA application generates a command, the PMA application sends the command to the PMA software via the Internet (step 722) and waits for confirmation from the PMA software that the command has been received and/or processed (step 724). If the PMA application has not received confirmation from the PMA software (step 726), the PMA application continues to wait (step 724). When the PMA application receives confirmation from the PMA software (step 726), the PMA application updates the control panel on the offsite device if necessary (step 728) and returns to step 706.

With reference to FIG. 8, process 800 begins by the PMA software of the onsite device connecting to the Internet (step 802) and collecting and monitoring data received from the controller of the PMA, i.e., controller 172 in FIG. 2 (step 804). In some embodiments, the onsite device has a control panel, and the PMA software also displays the received data in real-time in the control panel at step 804. As the PMA software continues to receive and monitor the data, the PMA software checks whether any of the pre-set rules in the PMA software is broken (step 806) based on the received data and whether it received a command from the PMA application (step 808). If the onsite device has a user interface, the PMA software may also check whether it received a user input at the onsite device; however, this scenario is not shown in FIG. 8 for the sake of simplicity.

Upon determining that a pre-set rule is broken (step 806) based on the received data, the PMA software may: (i) self-generate a command in response to the broken rule (step 810); request user input from the operator of the onsite device (step 812); or send an alert to the PMA application of the offsite device via the Internet (step 814). If the PMA software receives user input in response to its request at step 812, the PMA software generates a (manually-obtained) command based on the received user input (step 816). If the PMA software sent an alert to the PMA application at step 814, the PMA software checks whether it received the command from the PMA application (step 808). The PMA software may receive a command from the PMA application (step 808), whether the command is in response to an alert sent under step 814 or is sent by the PMA application without being prompted.

After the PMA software generates or receives a command, the PMA application sends the command to the PMA controller 172 (step 818) and waits for confirmation from the PMA controller 172 that the command has been received and/or processed (step 820). If the command is sent by the PMA application, the PMA software may modify the command prior to sending it the PMA controller. If the PMA software has not received confirmation from the PMA controller (step 822), the PMA software continues to wait (step 820). When the PMA software receives confirmation from the PMA controller (step 822), the PMA software may update the control panel on the onsite device if necessary (step 824) and send a confirmation to the PMA application if necessary (step 826), i.e., where the command was sent by the PMA application. The PMA software then returns to step 804.

Accordingly, the control system 100 can help transfer some of the monitoring and control responsibilities at a drilling site to offsite devices at remote locations, thereby reducing the number of necessary human operators on the rig. The control system 100 may also help the operator of the offsite device 204 feel like an integral part of the drilling operations by providing monitoring and control mechanisms that are the same or similar to those of the onsite device 202.

Although discussed in the context of MPD, a skilled person in the art can appreciate that the systems and methods of the present disclosure can be applied to other types of controlled pressure drilling techniques, such as pressurized mud-cap drilling, returns-flow-control drilling, dual gradient drilling, and underbalanced drilling.

INTERPRETATION OF TERMS

Unless the context clearly requires otherwise, throughout the description and the "comprise", "comprising", and the like are to be construed in an inclusive sense, as opposed to an exclusive or exhaustive sense; that is to say, in the sense of "including, but not limited to"; "connected", "coupled", or any variant thereof, means any connection or coupling, either direct or indirect, between two or more elements; the coupling or connection between the elements can be physical, logical, or a combination thereof, "herein", "above", "below", and words of similar import, when used to describe this specification, shall refer to this specification as a whole, and not to any particular portions of this specification; "or", in reference to a list of two or more items, covers all of the following interpretations of the word: any of the items in the list, all of the items in the list, and any combination of the items in the list; the singular forms "a", "an", and "the" also include the meaning of any appropriate plural forms.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments.

Various modifications to those embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the full scope consistent with the claims. All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples but should be given the broadest interpretation consistent with the description as a whole.

What is claimed is:

1. A method of controlling a pressure management apparatus (PMA) in a drilling system of a drilling site, the PMA comprising a choke having a choke motor and a choke valve motor, and wherein a controller of the PMA is configured to drive the choke motor to cause the choke to be more open or closed, and to drive the choke valve motor to place the choke online or offline; wherein the choke comprises a choke housing, a choke cartridge configured to be removably receivable in the choke housing, and a chock cartridge motor; and wherein the controller is configured to drive the choke cartridge motor to cause the choke cartridge to move relative to the choke housing, the method comprising:

connecting, by an offsite device, to the Internet, the offsite device being located at a remote location from a drilling site of a wellbore;

connecting, by the offsite device, to an onsite device in communication with the PMA at the drilling site via an Internet service, the onsite device being at or near the drilling site;

receiving, by the onsite device, PMA data from the controller in real-time;

receiving, by the offsite device, the PMA data in real-time from the onsite device via the Internet;

generating, by the offsite device, a command based, at least in part, on one or both of the PMA data and user input at the offsite device;

sending, by the offsite device, the command to the onsite device;

receiving, by the onsite device, the command;

sending, by the onsite device, the command to the controller;

receiving, by the controller, the command; and modifying, by the controller, the position of one or more of the choke, the choke valve, or the choke cartridge by controlling the choke motor, the choke valve motor, or the choke cartridge motor, respective components of the PMA based on the command.

2. The method of claim 1 further comprising:

receiving, by the onsite device, electronic drilling recorder (EDR) data from a rig of the drilling system in real-time; and receiving, by the offsite device, the EDR data in real-time from the onsite device via the Internet.

3. The method of claim 2, wherein the command is generated based, at least in part, on the EDR data.

4. The method of claim 1, wherein the step of modifying occurs before, during, or after at least one of; drilling of the wellbore, connection of a drill string at the drilling site, tripping out of the drill string from the wellbore, circulation of fluid in the wellbore, reaming of the wellbore, handling of a kick or a loss while drilling the wellbore, and an offline operation.

5. The method of claim 1, wherein the command is generated by the offsite device based, at least in part, on the PMA data and one or more pre-set rules.

6. The method of claim 5, wherein the one or more pre-set rules are selected from the group consisting of being generated by the offsite device, being generated by the onsite device, being set by a user, or a combination thereof.

7. The method of claim 1, wherein the command is generated based on the PMA data, and the method comprises:

generating, by the onsite device, an alert based on the PMA data;

prior to generating the command, receiving by the offsite device, the alert from the onsite device; and generating, by the offsite device, the command in response to the alert.

8. The method of claim 1, wherein the command is generated based on the user input, and the method comprises:

generating, by the onsite device, an alert based on the PMA data;

prior to generating the command, receiving by the offsite device, the alert from the onsite device;

prompting, by the offsite device, a user of the offsite device for input based on the alert; and receiving, by the offsite device, the user input from the user in response to the prompting.

9. The method of claim 1, wherein the PMA data comprises one or more of:

a flow rate;

a pressure;

a temperature;

a choke position;

a choke valve position;

a choke cartridge position;

a flowline valve position;

a bearing assembly position;

an image;

and a video.

10. The method of claim 2, wherein the EDR data comprises an injection pressure.

11. The method of claim 1 comprising displaying, by the offsite device, a control panel for presenting at least some of the PMA data in real-time and receiving the user input.

12. The method of claim 11 comprising, after the step of modifying:

receiving, by the onsite device, a confirmation from the PMA;

receiving, by the offsite device, the confirmation from the onsite device; and updating, by the offsite device, the control panel.

13. The method of claim 1, wherein the remote location is at a distance from a second drilling site of a second wellbore, and the method comprises:

connecting, by the offsite device, to a second onsite device in communication with a second PMA in a second drilling system at the second drilling site via the Internet service, the second onsite device being at or near the second drilling site;

receiving, by the second onsite device, second PMA data from a controller of the second PMA in real-time;

receiving, by the offsite device, the second PMA data in real-time from the second onsite device via the Internet;

generating, by the offsite device, a second command based, at least in part, on one or both of the second PMA data and a second user input at the offsite device;

sending, by the offsite device, the second command to the second onsite device;

receiving, by the second onsite device, the second command;

sending, by the second onsite device, the second command to the controller of the second PMA;

receiving, by the controller of the second PMA, the second command; and modifying, by the controller of the second PMA, a setting of the second PMA based on the second command.

14. A computer-implemented method of controlling a drilling operation of a managed pressure drilling system for a wellbore, the pressure drilling system having a pressure management apparatus (PMA) comprising a choke having a choke motor and a choke valve motor; wherein a controller of the PMA is configured to drive the choke motor to cause the choke to be more open or closed, and to drive the choke valve motor to place the choke online or offline; wherein the choke comprises a choke housing, a choke cartridge configured to be removably receivable in the choke housing, and a chock cartridge motor; and wherein the controller is configured to drive the choke cartridge motor to cause the choke cartridge to move relative to the choke housing, the method comprising:

(a) receiving a data stream from a pressure management apparatus and an electric drilling recorder system, the data stream generated in real-time by a plurality of sensors of the pressure management apparatus and the electronic drilling recorder;

(b) processing the data stream to generate operational information of the managed pressure drilling system, the operational information comprising one or more of:

a depth of the wellbore; a depth of a drill hit in the wellbore; a remaining length to a subsequent drill string segment connection;

a pump rate of a drilling fluid entering the wellbore; a flow rate of a drilling mud entering the pressure management apparatus;

a mud weight of the drilling fluid entering the wellbore; a mud weight of the drilling mud exiting the well bore;

a surface backpressure; an intermediate casing point (ICP) pressure;

an ICP equivalent circulating density (ECD);

a bottom hole pressure;

a bottom hole ECD;

surface backpressure limit;

a surge pressure;

a trip speed;

a status of a first choke of the pressure management apparatus;

a status of a second choke of the pressure management apparatus;

an openness of the first choke; and an openness of the second choke;

(c) providing a visual display of the operational information on an offsite device remote from the wellbore;

(d) repeating (a) to (c) over time, to update the visual display throughout the drilling operation; and (e) receiving by the PMA a command, and adjusting by the controller, the position of one or more of the choke, the choke valve, or the choke cartridge by controlling the choke motor, the choke valve motor, or the choke cartridge motor, respectively, based on the command.

15. The computer-implemented method of claim 14 comprising receiving a user input via the visual display, and wherein the command is determined based at least in apart on the user input.

* * * * *